US007705871B2

(12) United States Patent
Imamura et al.

(10) Patent No.: US 7,705,871 B2
(45) Date of Patent: Apr. 27, 2010

(54) OPTICAL WRITING DEVICE AND IMAGE FORMING APPARATUS INCLUDING THE OPTICAL WRITING DEVICE THAT PREVENTS SCATTERED TONER AND POWDER DUST FROM ENTERING THE OPTICAL WRITING DEVICE

(75) Inventors: Kazuhiko Imamura, Tokyo (JP); Takefumi Adachi, Kawaguchi (JP); Masaaki Tsuda, Yokohama (JP)

(73) Assignee: Ricoh Company Limited, Tokyo (JP)

( * ) Notice: Subject to any disclaimer, the term of this patent is extended or adjusted under 35 U.S.C. 154(b) by 1619 days.

(21) Appl. No.: 10/943,960

(22) Filed: Sep. 20, 2004

(65) Prior Publication Data

US 2005/0089315 A1 Apr. 28, 2005

(30) Foreign Application Priority Data

Sep. 18, 2003 (JP) ..... 2003-325941
Sep. 18, 2003 (JP) ..... 2003-326445
Oct. 30, 2003 (JP) ..... 2003-370582

(51) Int. Cl.
*B41J 15/14* (2006.01)

(52) U.S. Cl. ..... 347/242; 347/257; 399/92; 399/93; 399/98; 399/118

(58) Field of Classification Search ..... 399/92, 399/93, 98, 118; 347/242, 257
See application file for complete search history.

(56) References Cited

U.S. PATENT DOCUMENTS 4,469,430 A * 9/1984 Terashima ..... 347/134
4,866,482 A 9/1989 Hirasawa et al.
4,970,552 A * 11/1990 Okamoto et al. ..... 399/98
5,073,795 A * 12/1991 Nukaya ..... 399/98
5,729,793 A * 3/1998 Inoue ..... 399/92

(Continued)

FOREIGN PATENT DOCUMENTS

JP 4-323669 11/1992

(Continued)

OTHER PUBLICATIONS

U.S. Appl. No. 08/038,834, filed Mar. 29, 1993.

(Continued)

*Primary Examiner*—David P Porta
*Assistant Examiner*—Bryan P Ready
(74) *Attorney, Agent, or Firm*—Oblon, Spivak, McClelland, Maier & Neustadt, L.L.P.

(57) ABSTRACT

An image forming apparatus includes an optical writing device. The optical writing device includes an optical writing unit that emits laser light beams toward image carriers, an outer case that accommodates the optical writing unit, and air supplying devices that supply air into the outer case. The outer case includes openings through which the laser light beams pass. Another image forming apparatus includes an optical writing device that emits laser light beams toward image carriers to form latent images thereon, partition members that are interposed between the image carriers and the optical writing device and that have openings elongating along a scanning direction of the optical writing device, and shutter mechanisms including shutter members to open and close the openings. The laser light beams are emitted from the optical writing device toward the image carriers through the openings.

17 Claims, 18 Drawing Sheets

U.S. PATENT DOCUMENTS

| | | | |
|---|---|---|---|
| 6,308,024 | B1 | 10/2001 | Nakayama et al. |
| 6,339,491 | B1 | 1/2002 | Kondou et al. |
| 6,836,631 | B2 | 12/2004 | Mogi |

FOREIGN PATENT DOCUMENTS

| | | |
|---|---|---|
| JP | 5-188668 | 7/1993 |
| JP | 6-202393 | 7/1994 |
| JP | 7-114327 | 5/1995 |
| JP | 7-234626 | 9/1995 |
| JP | 9-244362 | 9/1997 |
| JP | 10-58750 | 3/1998 |
| JP | 10-207308 | 8/1998 |
| JP | 2000-43280 | 2/2000 |
| JP | 2000-177167 | 6/2000 |
| JP | 2000-263839 | 9/2000 |
| JP | 2001-56588 | 2/2001 |
| JP | 2001-75442 | 3/2001 |
| JP | 2001-138574 | 5/2001 |
| JP | 2001-209220 | 8/2001 |
| JP | 2002-62695 | 2/2002 |
| JP | 2002-149017 | 5/2002 |
| JP | 2002-251113 | 9/2002 |
| JP | 2003-29189 | 1/2003 |
| JP | 2003-76247 | 3/2003 |
| JP | 2003-131159 | 5/2003 |

OTHER PUBLICATIONS

U.S. Appl. No. 09/791,797, filed Feb. 26, 2001, Adachi.
U.S. Appl. No. 10/743,865, filed Dec. 24, 2003, Matsumoto et al.
U.S. Appl. No. 11/414,176, filed May 1, 2006, Adachi, et al.
U.S. Appl. No. 11/253,664, filed Oct. 20, 2005, Adachi et al.

* cited by examiner

OPTICAL WRITING DEVICE AND IMAGE FORMING APPARATUS INCLUDING THE OPTICAL WRITING DEVICE THAT PREVENTS SCATTERED TONER AND POWDER DUST FROM ENTERING THE OPTICAL WRITING DEVICE

CROSS-REFERENCE TO RELATED APPLICATIONS

This application claims priority to Japanese Patent Application No. 2003-326445 filed in the Japanese Patent Office on Sep. 18, 2003, Japanese Patent Application No. 2003-325941 filed in the Japanese Patent Office on Sep. 18, 2003, and Japanese Patent Application No. 2003-370582 filed in the Japanese Patent Office on Oct. 30, 2003, the entire contents of which are incorporated by reference herein.

BACKGROUND OF THE INVENTION

1. Field of the Invention

The present invention relates to an optical writing device and an image forming apparatus including the optical writing device that prevents scattered toner and powder dust from entering the optical writing device.

2. Discussion of the Related Art

An electrophotographic image forming apparatus includes an optical writing unit having optical members, such as a semiconductor laser and a polygon mirror. In the electrophotographic image forming apparatus, an electrostatic latent image is formed on an image carrier by emitting a laser light beam from the optical writing unit to a surface of the image carrier. The electrostatic latent image is developed with toner supplied from a developing device and is formed into a toner image. The toner image formed on the image carrier is transferred to a recording medium, and is then fixed onto the recording medium. Subsequently, the recording medium having a fixed toner image is discharged from the image forming apparatus.

In this image forming apparatus, when scattered toner and powder dust enter an outer case that accommodates an optical writing unit, the scattered toner and powder dust can adhere to the optical writing unit, thereby interrupting the emission of a laser light beam from the optical writing unit. As a result, image quality can be deteriorated.

If image quality is deteriorated due to scattered toner and powder dust adhered to the optical writing unit, the optical writing unit needs to be cleaned. In this condition, it can require a lot of time and efforts for cleaning.

Especially when an optical writing unit is disposed below an image forming device including an image carrier and a developing device in an image forming apparatus, scattered toner and powder dust can tend to enter an outer case that accommodates the optical writing unit.

To prevent scattered toner and powder dust from entering an optical writing unit, some conventional image forming apparatuses employ an airflow generating mechanism that generates a flow of air in a space formed between an image forming device and an optical writing unit. For example, Published Japanese Patent application No. 2001-138574 describes an image forming apparatus employing an airflow generating mechanism.

However, when scattered toner and powder dust are blown off by airflow, some scattered toner and powder dust can scatter toward an optical writing unit.

In some full-color image forming apparatuses, such as a printer, image carriers and developing devices are disposed above an optical writing device. In this configuration, toner and powder dust scattered from the image carriers and the developing devices can enter the optical writing device and accumulate at positions where laser light beams are emitted from the optical writing device. Accordingly, the accumulated toner and powder dust interrupt the emission of laser light beams toward the image carriers, thereby causing an occurrence of a white streak image.

Therefore, as discovered by the present inventors, it is desirable to provide an optical writing device and an image forming apparatus including the optical writing device that prevents scattered toner and powder dust from entering the optical writing device, and which prevents the deterioration of image quality caused by scattered toner and powder entered in the optical writing device.

SUMMARY OF THE INVENTION

The present invention can provide an optical writing device including an optical writing unit configured to emit a laser light beam, an outer case configured to accommodate the optical writing unit, the outer case including at least one first opening configured to pass the laser light beam therethrough, and at least one air supplying device configured to supply air into the outer case.

The optical writing unit can include optical members and an inner case configured to accommodate the optical members. The inner case can include at least one second opening configured to permit passage of the laser light beam toward the at least one first opening therethrough. The optical writing unit can further include a dust-proof glass configured to close the at least one second opening. The dust-proof glass can be configured to permit the laser light beam to be transmitted therethrough.

The at least one first opening can include a plurality of first openings, and the plurality of first openings can have at least two different sizes of areas configured such that each speed of air supplied into the outer case by the at least one air supplying device and blown out from the plurality of first openings is greater than or equal to a predetermined value.

The present invention can further provide an image forming apparatus including an image forming device having an image carrier, the image forming device configured to form a toner image on the image carrier by an electrophotography process, and the above-described optical writing device configured to form an electrophotographic latent image on the image carrier.

The image forming device can include a process cartridge configured to be detachably attached to the image forming apparatus.

The present invention can further provide an image forming apparatus including at least one image carrier configured to carry a latent image thereon, and an optical writing device configured to emit a laser light beam toward the at least one image carrier to form a latent image on the at least one image carrier. The optical writing device is disposed below the at least one image carrier. The image forming apparatus further includes a partition member interposed between the at least one image carrier and the optical writing device. The partition member includes an opening elongating along a scanning direction of the optical writing device, and configured such that the laser light beam emitted from the optical writing device toward the at least one image carrier passes therethrough. The image forming apparatus further includes a shutter mechanism having a shutter member configured to open and close the opening.

The image forming apparatus can further include a drive device configured to drive the shutter mechanism to move the shutter member to open and close the opening.

The image forming apparatus can further include a process cartridge comprising the at least one image carrier

BRIEF DESCRIPTION OF THE DRAWINGS

A more complete appreciation of the present invention and many of the attendant advantages thereof will be readily obtained as the same becomes better understood by reference to the following detailed description when considered in connection with the accompanying drawings, wherein.

DETAILED DESCRIPTION

Figure 1:
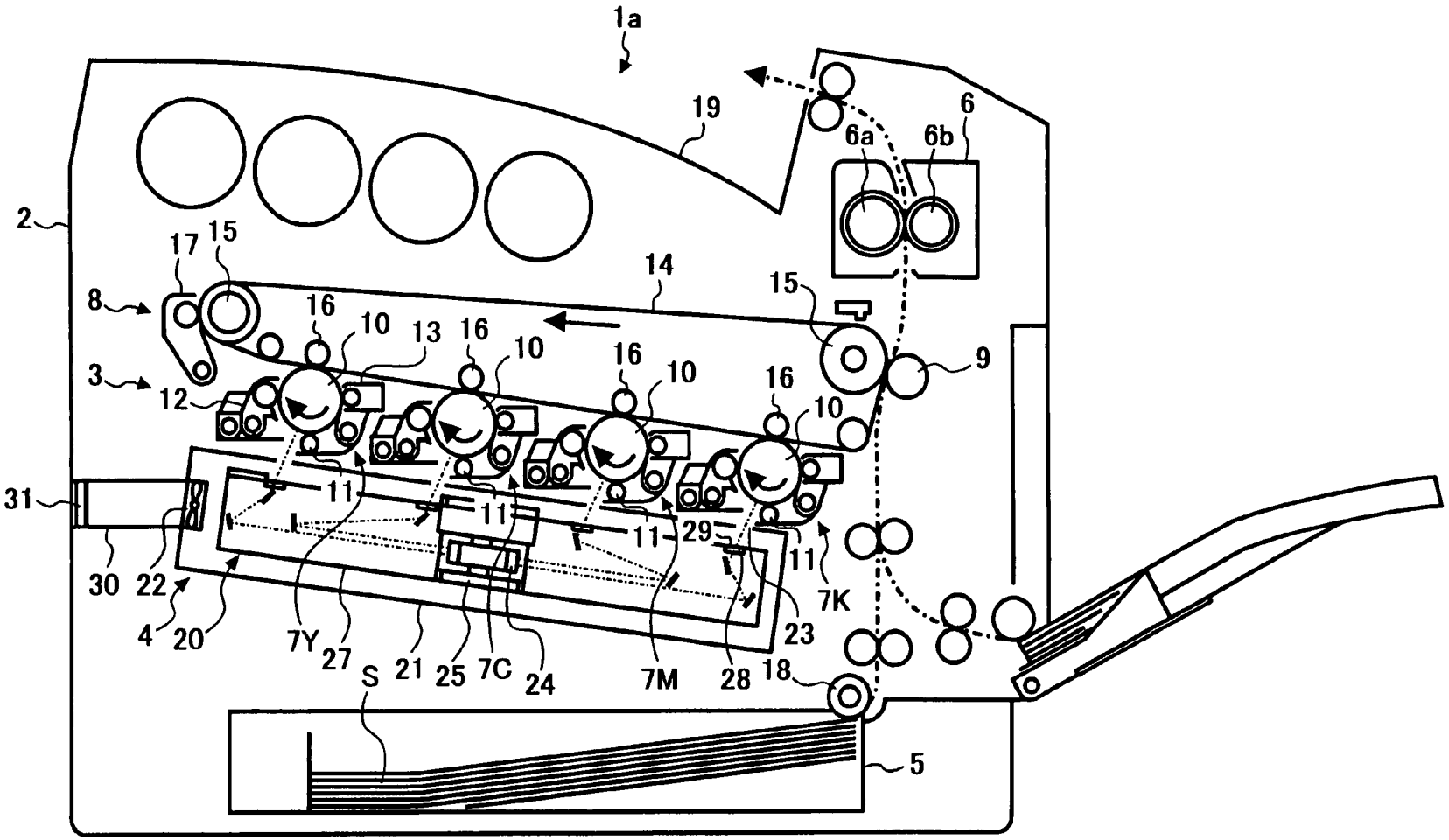
FIG. 1 is a side view of a color printer according to an embodiment of the present invention.

One or more preferred embodiments of the present invention are described in detail referring to the drawings, wherein like reference numerals designate identical or corresponding parts throughout the several views.

FIG. 1 is a side view of a color printer as an example of an image forming apparatus according to an embodiment of the present invention. A main body 2 of a color printer 1*a* includes an image forming device 3, an optical writing device 4, a sheet feeding cassette 5, and a fixing device 6.

The image forming device 3 includes four process cartridges 7Y, 7C, 7M, 7K configured to form toner images of different colors. Suffix characters "Y", "C", "M" and "K" represent yellow, cyan, magenta, and black colors, respectively. The image forming device 3 further includes an intermediate transfer unit 8 and a secondary transfer roller 9, both of which are disposed above the process cartridges 7Y, 7C, 7M, 7K.

The configurations of the process cartridges 7Y, 7C, 7M, 7K are substantially the same except for the color of the toner. Each of the process cartridges 7Y, 7C, 7M, 7K includes a photoreceptor 10 acting as an image carrier that is rotated in the direction indicated by the arrow in FIG. 1. Arranged around the photoreceptor 10 are a charging roller 11, a developing device 12, and a cleaning device 13 in the order of the electrophotographic process. Each of the process cartridges 7Y, 7C, 7M, 7K integrally accommodates the photoreceptor 10, the charging roller 11, the developing device 12, and the cleaning device 13. Alternatively, each of the process cartridges 7Y, 7C, 7M, 7K can integrally accommodate the photoreceptor 10 and at least one of the charging roller 11, the developing device 12, and the cleaning device 13. The process cartridges 7Y, 7C, 7M, 7K are detachably attached to the main body 2 of the color printer 1*a*.

The intermediate transfer unit 8 includes an intermediate transfer belt 14, a plurality of support rollers 15 that rotatably support the intermediate transfer belt 14, four primary transfer rollers 16, and a belt cleaning device 17. The intermediate transfer belt 14 includes a base layer which can be formed from resin film or rubber having a thickness in a range of about 50 μm to about 600 μm. Further, the intermediate transfer belt 14 can have a resistivity which allows a toner image on the photoreceptor 10 to be transferred onto the intermediate transfer belt 14.

The optical writing device 4 is disposed below the image forming device 3. The optical writing device 4 emits laser light beams corresponding to image data for respective colors to the surfaces of the photoreceptors 10, respectively, thereby writing electrostatic latent images for respective colors on the surfaces of the photoreceptors 10, respectively.

The sheet feeding cassette 5 accommodates a stack of recording sheets S. A sheet feeding roller 18 feeds the recording sheets S one by one from the sheet feeding cassette 5.

The fixing device 6 includes a fixing roller 6*a* and a pressure roller 6*b*. A toner image is fixed onto the recording sheet S through the application of heat and pressure while the recording sheet S passes through a nip part between the fixing roller 6*a* and the pressure roller 6*b*.

Basic operation of the color printer 1*a* is described. The optical writing device 4 emits a laser light beam corresponding to image data to the surface of the photoreceptor 10, thereby forming an electrostatic latent image on the photoreceptor 10. The developing device 12 develops the electrostatic latent image with toner and forms a toner image. Subsequently, toner images of different colors formed on the respective surfaces of the photoreceptors 10 are sequentially transferred onto the intermediate transfer belt 14 while being each superimposed thereon by the primary transfer electric field formed by the primary transfer rollers 16. The intermediate transfer belt 14 moves in synchronization with the rotations of the photoreceptors 10. As a result, a superimposed color toner image is formed on the intermediate transfer belt 14.

The superimposed color toner image on the intermediate transfer belt 14 is secondarily transferred onto the recording sheet S fed from the sheet feeding cassette 5 at a secondary transfer nip part formed between the secondary transfer roller 9 and the intermediate transfer belt 14 by the secondary transfer electric field formed by the secondary transfer roller 9. The color toner image is fixed onto the recording sheet S in the fixing device 6. The recording sheet S having passed through the fixing device 6 is discharged onto a sheet discharging tray 19 disposed on the upper surface of the main body 2 of the color printer 1*a*.

Figure 2:
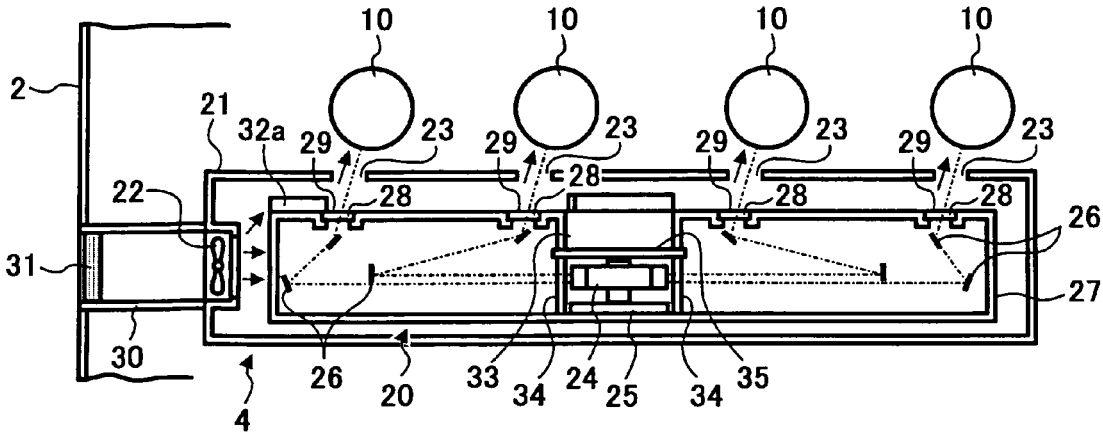
FIG. 2 is a side view of an optical writing device according to an embodiment of the present invention.

FIG. 2 is a side view of the optical writing device 4. The optical writing device 4 includes an optical writing unit 20 that emits a laser light beam for writing, an outer case 21 that accommodates the optical writing unit 20, an air supplying device 22 that supplies air into the outer case 21, and an air-intake path 30 through which outside air is taken into the outer case 21 by driving the air supplying device 22. Four slit openings 23 are disposed in an upper portion of the outer case 21 to pass laser light beams through the slit openings 23, respectively. The number of the slit openings 23 is equal to the number of the photoreceptors 10, that is, four in this embodiment. The slit openings 23 are disposed parallel to the axial direction of the photoreceptors 10 side by side, and the length of the slit openings 23 is substantially equal to the length of the photoreceptors 10 in their axial direction.

The optical writing unit 20 includes optical members, such as four semiconductor lasers (not shown) that emit laser light beams, a polygon mirror 24 that reflects the laser light beams emitted from the semiconductor lasers, a polygon motor 25 that drives the polygon mirror 24 to rotate, and a plurality of mirrors 26 that reflect the laser light beams reflected from the polygon mirror 24 toward the slit openings 23. An inner case 27 accommodates the semiconductor lasers, the polygon mirror 24, the polygon motor 25, and the mirrors 26. Four slit openings 28 are disposed in the inner case 27 to pass laser light beams being emitted toward the slit openings 23 through the slit openings 28. The number of the slit openings 28 is also equal to the number of the photoreceptors 10, that is, four in this embodiment. The slit openings 28 are disposed parallel to the axial direction of the photoreceptors 10, and the length of the slit openings 28 is substantially equal to the length of the photoreceptors 10 in their axial direction. Each of the slit openings 28 is closed with a dust-proof glass 29 that allows a laser light beam to transmit it. The optical writing unit 20 is detachably attached into the outer case 21 for easy maintenance. If a trouble occurs in the optical writing unit 20, the inner case 27 accommodating the optical writing unit 20 is easily removed from the outer case 21 to be replaced with a new one. A lock mechanism (not shown) is provided in the outer case 21 to position and lock the optical writing unit 20.

The four semiconductor lasers emit laser light beams corresponding to image data for respective colors, such as yellow, magenta, cyan, and black. Electrostatic latent images of respective colors are formed on the photoreceptors 10 accommodated in the process cartridges 7Y, 7C, 7M, and 7K, respectively, by emitting the laser light beams from the four semiconductor lasers to the photoreceptors 10.

The air-intake path 30 is provided to communicate the outside of the main body 2 of the color printer 1*a* to the inside of the outer case 21. The air supplying device 22 is disposed at the position in the outer case 21 where the air-intake path 30 is connected to the outer case 21. The outside air is taken into the outer case 21 through the air-intake path 30 by driving the air supplying device 22.

Figure 3:
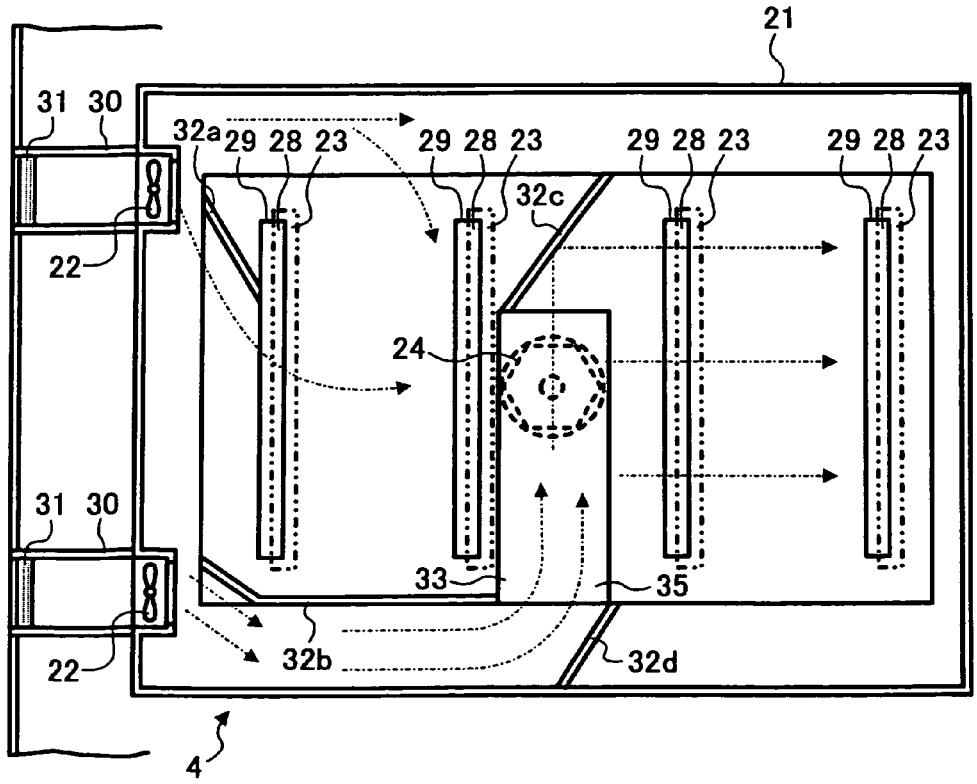
FIG. 3 is a plan view of the optical writing device of FIG. 2.

FIG. 3 is a plan view of the optical writing device 4 of FIG. 2. As illustrated in FIG. 3, two pairs of the air-intake path 30 and the air supplying devices 22 are disposed in the vicinity of both end sides of the slit opening 23 in its longitudinal direction, respectively. Referring back to FIG. 2, a filter 31 for collecting dust is attached to the end portion of the air-intake path 30 which communicates with the outside of the main body 2. The filter 31 eliminates powder dust in the air supplied into the outer case 21 by driving the air supplying device 22. The filter 31 is detachably attached into the air-intake path 30 for easy maintenance. If the filter 31 is clogged, the filter 31 is easily replaced with a new one. The air supplied into the outer case 21 by driving the air supplying device 22 flows in a space formed between the inner peripheral surface of the outer case 21 and the outer peripheral surface of the inner case 27. Further, as indicated by the arrows in FIG. 2, the air is discharged from the outer case 21 while being blown out from the slit openings 23 disposed in the outer case 21.

As illustrated in FIG. 3, guide ribs 32*a*, 32*b*, 32*c*, and 32*d* are disposed at the outer peripheral portion of the inner case 27 to direct the air supplied into the outer case 21 to the slit openings 23 such that the air is blown out from the slit openings 23 substantially equally. Such a problem can be prevented by forming the guide ribs 32*a*, 32*b*, 32*c*, and 32*d* that a large amount of air supplied into the outer case 21 is blown out from the slit opening 23 disposed at the nearest side relative to the air supplying device 22 and a lesser amount of air is blown out from the other slit openings 23. If the amount of air blown out from the slit opening 23 is relatively small, the scattered toner and powder dust floating in the main body 2 of the color printer 1*a* can enter the outer case 21 through the slit opening 23.

As illustrated in FIGS. 2 and 3, an airflow path 33 is formed at an outer peripheral portion of the inner case 27 to cool the polygon motor 25. The area in which the polygon motor 25 and the polygon mirror 24 are disposed in the inner case 27 is separated by soundproof glasses 34 that allow a laser light beam to be transmitted therethrough. The airflow path 33 is formed by denting or deforming the upper portion of the inner case 27 above the area, and is disposed adjacent to the polygon motor 25. By passing the air supplied into the outer case 21 through the airflow path 33, the heat generated by rotating the polygon motor 25 at a high speed, is released in the airflow. Thus, the air passing through the airflow path 33 facilitates cooling of the polygon motor 25.

Further, a portion of the airflow path 33 adjacent to the polygon motor 25 is formed from a metal plate 35 having high thermal conductivity. Therefore, the heat generated from the polygon motor 25 is preferably released from the metal plate 35 into the air passing through the airflow path 33, so that the polygon motor 25 is efficiently cooled. As illustrated in FIG.

3, the guide rib 32*d* directs a portion of the air supplied into the outer case 21 to the airflow path 33 as well as directs the air supplied into the outer case 21 such that the air is blown out from the slit openings 23 substantially equally.

In the above-described configuration of the optical writing device 4, the air outside of the main body 2 of the color printer 1*a* is supplied into the outer case 21 through the air-intake path 30 by driving the air supplying device 22 during image formation. The outside air contains significantly low amount of scattered toner and powder dust as compared to the air in the main body 2 of the color printer 1*a*. In addition, if powder dust is contained in the outside air, the filter 31 removes the powder dust before the outside air is supplied into the outer case 21. Thus, clean air can be supplied into the outer case 21, and powder dust can be prevented from entering the outer case 21.

When the air outside of the main body 2 of the color printer 1*a* is supplied into the outer case 21 by driving the air supplying device 22, air pressure in the outer case 21 is increased. The air supplied into the outer case 21 flows as indicated by the arrows in FIG. 2 and discharges from the outer case 21 while being blown out from the slit openings 23. The air supplied into the outer case 21 is directed to the slit openings 23 by the guide ribs 32*a*, 32*b*, 32*c*, and 32*d*, and is blown out from the slit openings 23 substantially equally. Thereby, the scattered toner and powder dust floating in the main body 2 of the color printer 1*a* can be prevented from entering the outer case 21 through the slit openings 23. Accordingly, the scattered toner and powder dust can be prevented from adhering to the dust-proof glasses 29 provided in the inner case 27. As a result, the deterioration of image quality caused by scattered toner and powder dust adhered to the dust-proof glasses 29 can be minimized or avoided.

An optical writing device according to another embodiment of the present invention is described with reference to FIGS. 4 and 5. Members having substantially the same functions as those used in the optical writing device 4 of FIGS. 1 through 3 are designated with the same reference characters.

Figure 4:
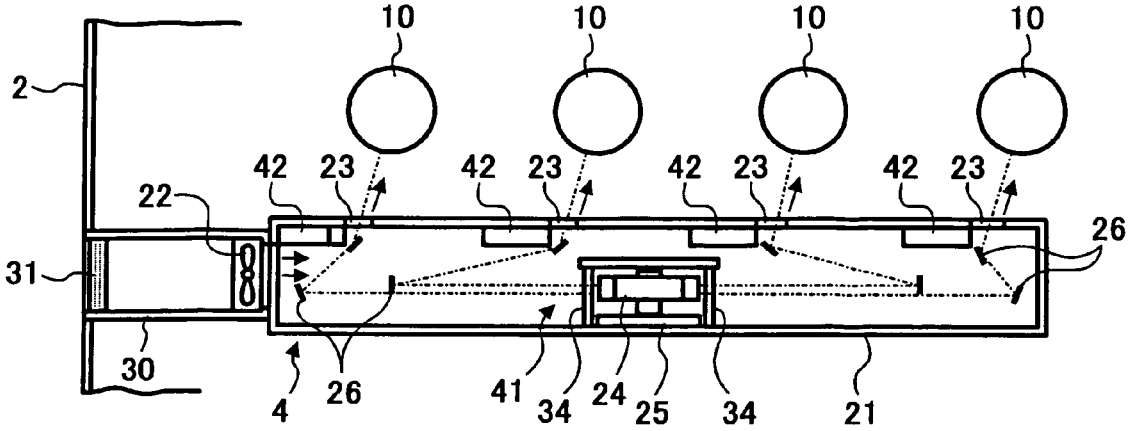
FIG. 4 is a side view of an optical writing device according to another embodiment of the present invention.
Figure 5:
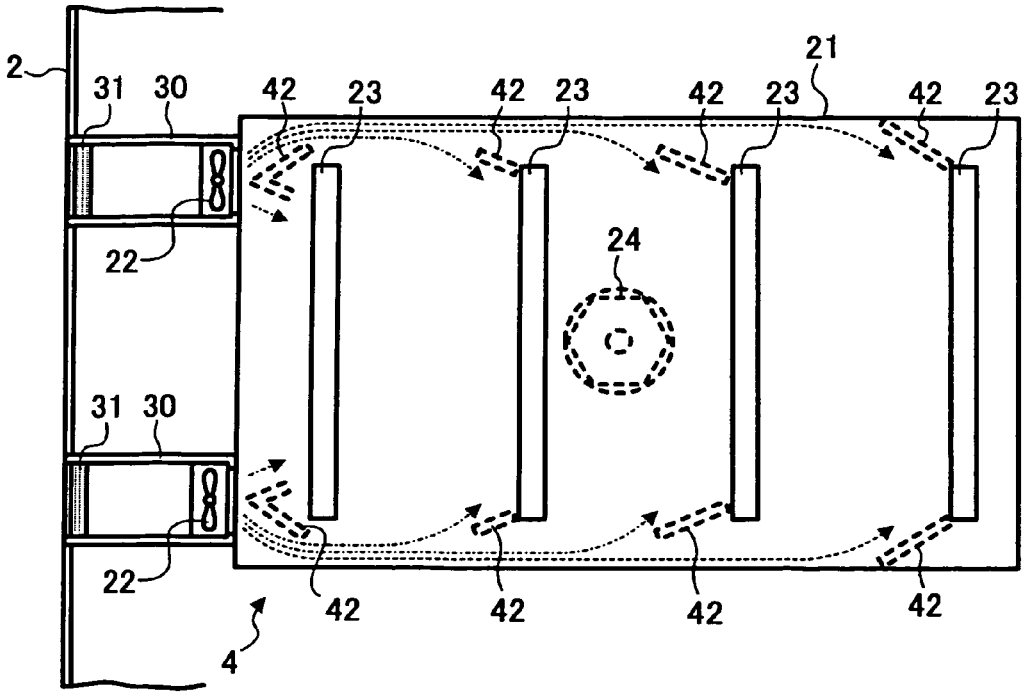
FIG. 5 is a plan view of the optical writing device of FIG. 4.

FIG. 4 is a side view of the optical writing device 4, and FIG. 5 is a plan view of the optical writing device 4. The optical writing device 4 of FIG. 4 includes an optical writing unit 41 that emits a laser light beam for writing, the outer case 21 that accommodates the optical writing unit 41, the air supplying device 22 that supplies air into the outer case 21, and the air-intake path 30 through which outside air is taken into the outer case 21 by driving the air supplying device 22. Four slit openings 23 are disposed in an upper portion of the outer case 21 to pass laser light beams through the slit openings 23, respectively.

The optical writing unit 41 includes optical members, such as four semiconductor lasers (not shown) that emit laser light beams, the polygon mirror 24 that reflects the laser light beams emitted from the semiconductor lasers, the polygon motor 25 that drives the polygon mirror 24 to rotate, and a plurality of mirrors 26 that reflect the laser light beams reflected from the polygon mirror 24 toward the slit openings 23. In this embodiment, optical members are disposed at positions where they are exposed to the air supplied into the outer case 21. That is, the semiconductor lasers, the soundproof glasses 34 that surround the polygon mirror 24 and the polygon motor 25, and the mirrors 26 are disposed at positions where they are exposed to the air supplied into the outer case 21. Restated, a portion of the optical members, such as the polygon mirror 24, and the polygon motor 25, is exposed to the air supplied into the outer case 21 via a transparent cover member, such as the soundproof glasses 34.

Guide ribs 42 are disposed on the inner peripheral surface of the outer case 21 to direct the air supplied into the outer case 21 to the slit openings 23 such that the air is blown out from the slit openings 23 substantially equally. A potential problem, in which the guide ribs 42 are disposed so that a relatively greater amount of air supplied into the outer case 21 is blown out from the slit opening 23 disposed at the nearest side relative to the air supplying device 22 and a relatively lesser amount of air is blown out from the other slit openings 23, can be avoided. If the amount of air blown out from the slit opening 23 is relatively small, the scattered toner and powder dust floating in the main body 2 of the color printer 1*a* can enter the outer case 21 through the slit opening 23.

In the above-described configuration of the optical writing device 4, the air outside of the main body 2 of the color printer 1*a* is supplied into the outer case 21 through the air-intake path 30 by driving the air supplying device 22 during image formation. The outside air contains significantly lesser amount of scattered toner and powder dust as compared to the air in the main body 2 of the color printer 1*a*. In addition, if powder dust is contained in the outside air, the filter 31 removes the powder dust before the outside air is supplied into the outer case 21. Thus, clean air can be supplied into the outer case 21, and powder dust can be prevented from entering the outer case 21.

When the air outside of the main body 2 of the color printer 1*a* is supplied into the outer case 21 by driving the air supplying device 22, the air pressure in the outer case 21 is increased. The air supplied into the outer case 21 flows as indicated by the arrows in FIGS. 4 and 5 and discharges from the outer case 21 while being blown out from the slit openings 23. The air supplied into the outer case 21 is directed to the slit openings 23 by the guide ribs 42, and is blown out from the slit openings 23 substantially equally. Thereby, the scattered toner and powder dust floating in the main body 2 of the color printer 1*a* can be prevented from entering the outer case 21 through the slit openings 23. Accordingly, the scattered toner and powder dust can be prevented from adhering to the semiconductor lasers, the sound-proof glasses 34 surrounding the polygon mirror 24 and the polygon motor 25, and the mirrors 26 which form the optical writing unit 41. As a result, the deterioration of image quality caused by scattered toner and powder dust adhered to the semiconductor lasers, the soundproof glasses 34 surrounding the polygon mirror 24 and the polygon motor 25, and the mirrors 26 can be minimized or avoided.

In this embodiment, because an expensive part, such as a dust-proof glass that closes the slit opening 23, need not be provided in the optical writing device 4, the cost of the device can be reduced.

Figure 6:
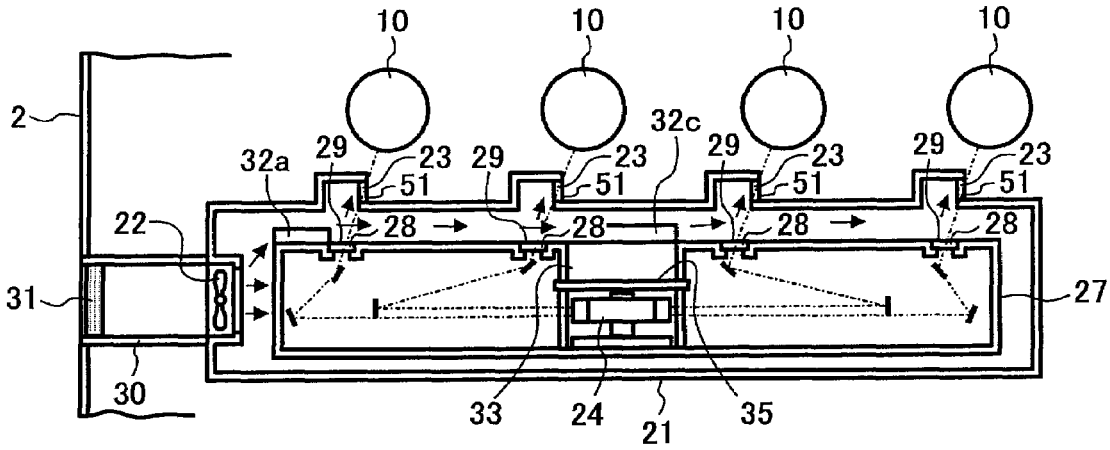
FIG. 6 is a side view of an optical writing device according to another embodiment of the present invention.

Next, an optical writing device according to another embodiment of the present invention is described with reference to FIG. 6. In this embodiment, the configuration of the optical writing device 4 is substantially similar to that of the optical writing device 4 of FIG. 2 except for rise wall portions 51 disposed at the upper portion of the outer case 21. The rise wall portions 51 stand upward substantially perpendicularly relative to a surface of the upper portion of the outer case 21. The slit openings 23 are disposed in the rise wall portions 51, respectively. The projected area of the slit opening 23 seen from above the slit opening 23 in the vertical direction is substantially zero.

In this configuration, by forming the slit opening 23 in the rise wall portion 51 and providing the projected area of the slit opening 23 seen from above the slit opening 23 in the vertical direction as substantially zero, the scattered toner and powder dust floating in the main body 2 of the color printer 1*a* can be prevented from entering the outer case 21 through the slit openings 23. Accordingly, the scattered toner and powder dust can be prevented from adhering to the dust-proof glasses 29 provided in the inner case 27. As a result, the deterioration of image quality caused by scattered toner and powder dust adhered to the dust-proof glasses 29 can be minimized or avoided.

Figure 7:
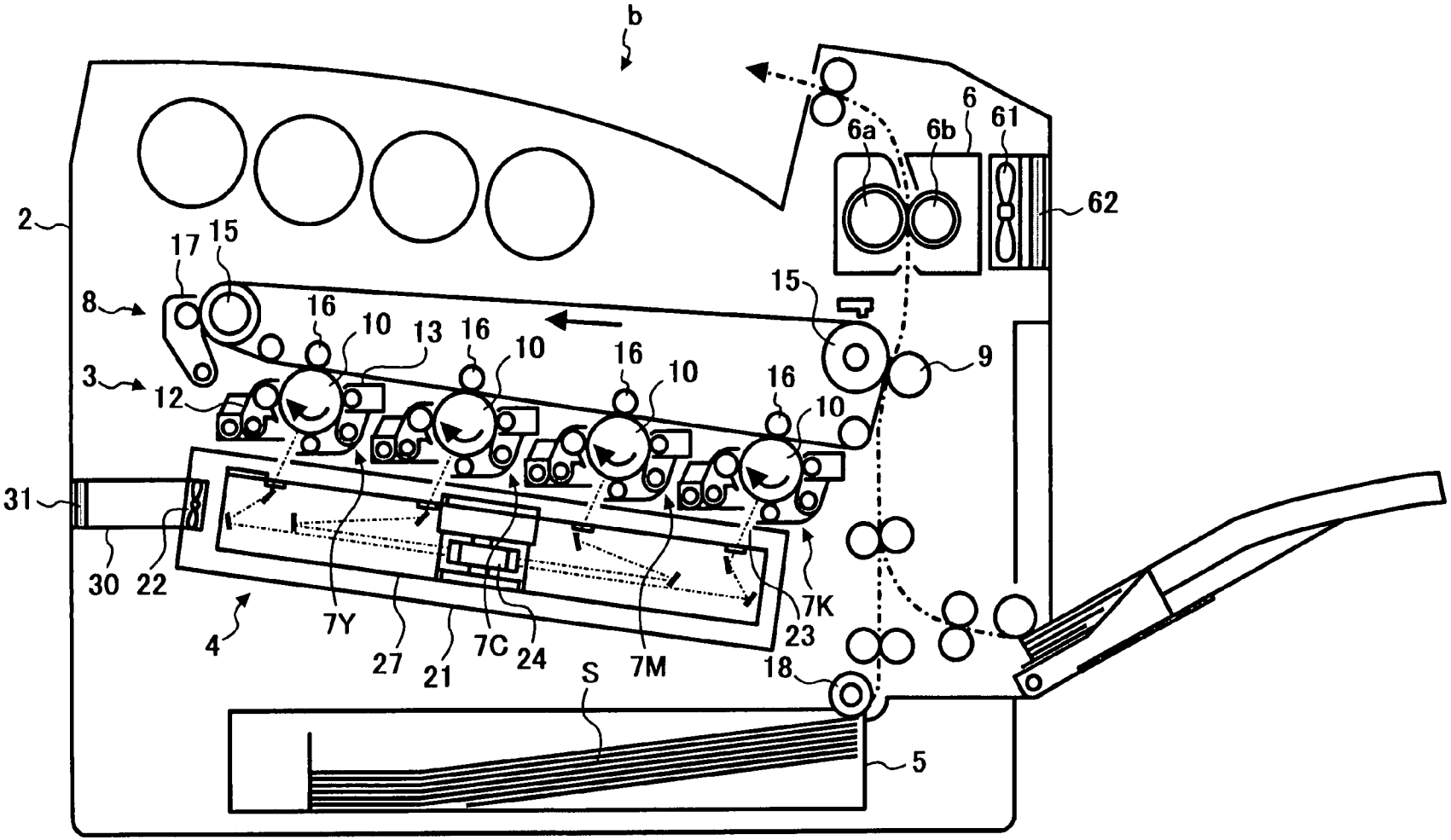
FIG. 7 is a side view of a color printer according to another embodiment of the present invention.

Next, a color printer including an optical writing device according to another embodiment of the present invention is described with reference to FIG. 7. FIG. 7 is a side view of a color printer 1*b* according to another embodiment of the present invention. The configuration of the color printer 1*b* of FIG. 7 is similar to that of the color printer of FIG. 1 except that the color printer 1*b* of FIG. 7 includes a fan 61 acting as an air exhaust device, and a filter 62 in the main body 2. The air outside of the outer case 21 is exhausted from the main body 2 by driving the fan 61. The filter 62 collects scattered toner and powder dust contained in the air exhausted from the main body 2.

In the color printer 1*b*, the air pressure outside of the outer case 21 in the main body 2 is less than the atmospheric pressure by driving the fan 61 during image formation. As a result, the air, which is supplied into the outer case 21 by driving the air supplying device 22, blows out of the slit openings 23 relatively forcefully, and the scattered toner and powder dust floating in the main body 2 are significantly prevented from entering the outer case 21 through the slit openings 23. Thus, the deterioration of image quality caused by scattered toner and powder dust entered into the outer case 21 can be minimized or avoided.

Further, because the filter 62 collects scattered toner and powder dust floating in the main body 2 by driving the fan 61, scattered toner and powder dust can be prevented from entering the outer case 21 through the slit openings 23.

Next, an image forming apparatus including another optical writing device according to another embodiment of the present invention is described.

Figure 8:
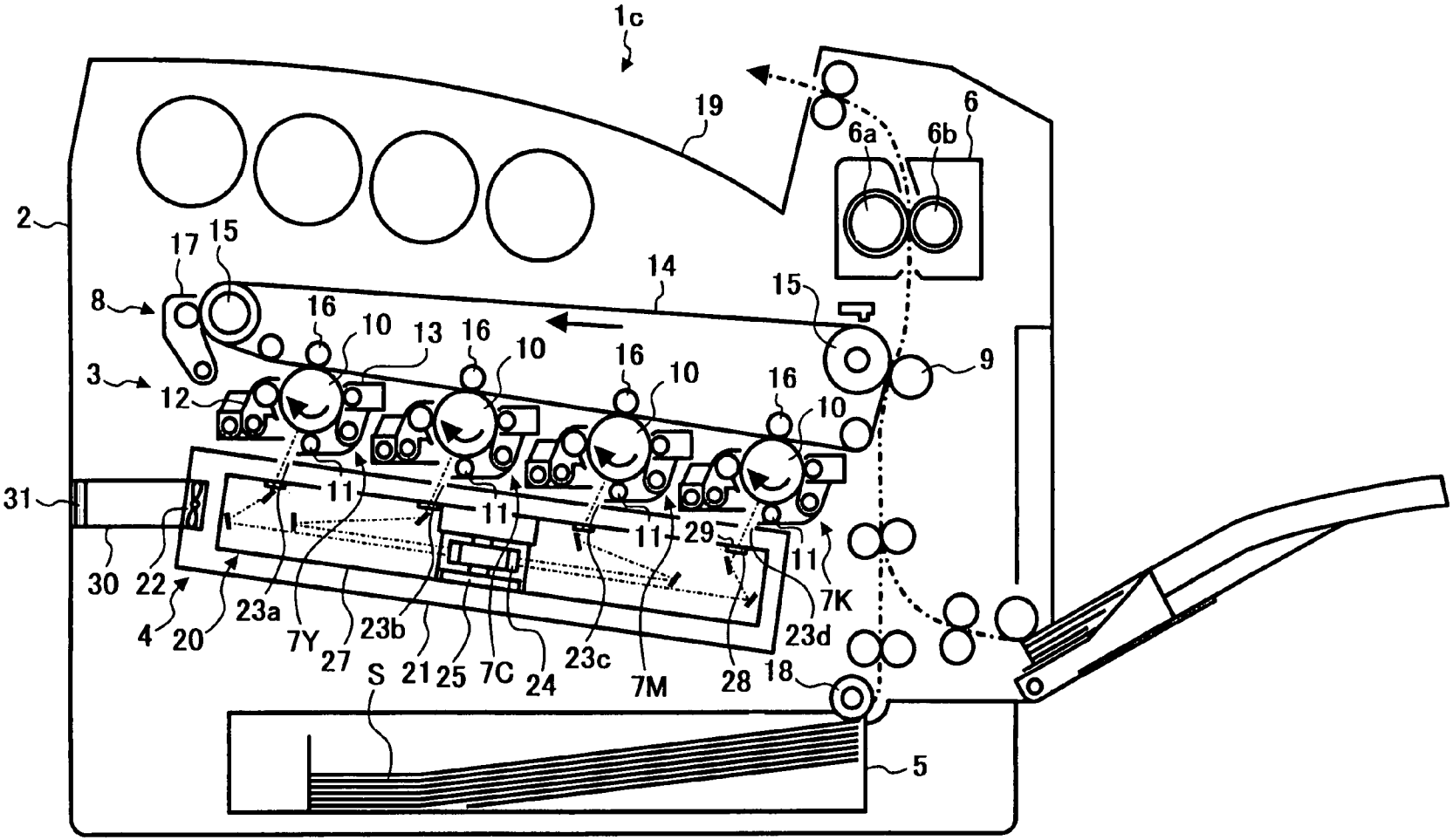
FIG. 8 is a side view of a color printer according to another embodiment of the present invention.

FIG. 8 is a side view of a color printer 1*b* as an example of an image forming apparatus according to an embodiment of the present invention. The configuration of the color printer 1*b* of FIG. 8 is similar to that of the color printer 1 of FIG. 1 except for the optical writing device 4.

Figure 9:
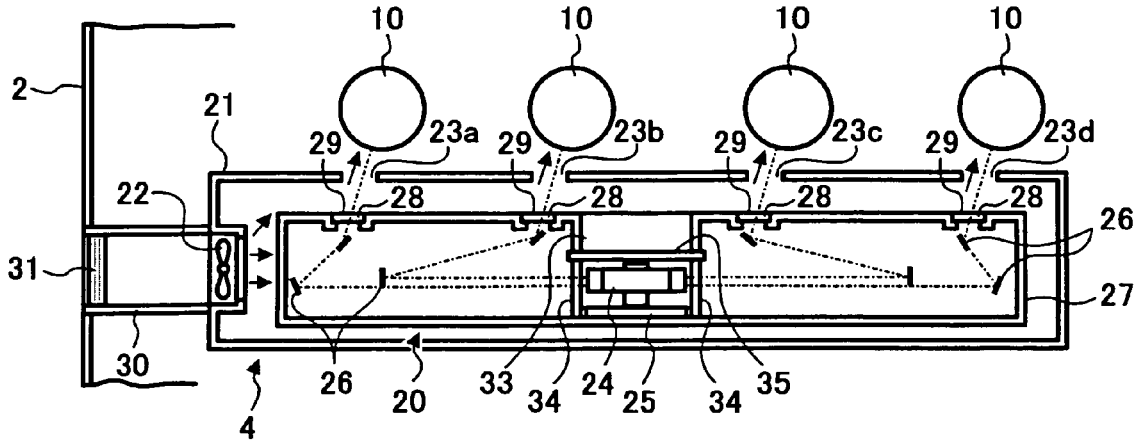
FIG. 9 is a side view of an optical writing device according to another embodiment of the present invention.

FIG. 9 is a side view of the optical writing device 4 according to another embodiment of the present invention. The optical writing device 4 includes the optical writing unit 20 that emits a laser light beam for writing, the outer case 21 that accommodates the optical writing unit 20, the air supplying device 22 that supplies air into the outer case 21, and the air-intake path 30 through which outside air is taken into the outer case 21 by driving the air supplying device 22. Four slit openings 23*a*, 23*b*, 23*c*, and 23*d* are disposed in the upper surface portion of the outer case 21 to pass laser light beams through the slit openings 23*a*, 23*b*, 23*c*, and 23*d*, respectively. The slit openings 23*a*, 23*b*, 23*c*, and 23*d* are disposed at positions where the slit openings 23*a*, 23*b*, 23*c*, and 23*d* face or oppose the photoreceptors 10 on which toner images of different colors are formed, respectively. Further, the slit openings 23*a*, 23*b*, 23*c*, and 23*d* are disposed parallel to the axial direction of the photoreceptors 10 side by side. The areas of the slit openings 23*a*, 23*b*, 23*c*, and 23*d* are different with respect to each other (described below).

The optical writing unit 20 includes optical members, such as four semiconductor lasers (not shown) that emit laser light beams, the polygon mirror 24 that reflects the laser light beams emitted from the semiconductor lasers, the polygon motor 25 that drives the polygon mirror 24 to rotate, and the plurality of mirrors 26 that reflect the laser light beams reflected from the polygon mirror 24 toward the slit openings 23*a*, 23*b*, 23*c*, and 23*d*. The inner case 27 accommodates the semiconductor lasers, the polygon mirror 24, the polygon motor 25, and the mirrors 26. The four slit openings 28 are disposed in the inner case 27 to permit passage of laser light beams being emitted to the slit openings 23*a*, 23*b*, 23*c*, and 23*d* through the slit openings 28, respectively. The slit openings 28 are disposed parallel to the axial direction of the photoreceptors 10. Each of the slit openings 28 is closed with the dust-proof glass 29 that allows a laser light beam to be transmitted therethrough. The optical writing unit 20 is detachably attached into the outer case 21 for easy maintenance. A lock mechanism (not shown) is provided in the outer case 21 to position and lock the optical writing unit 20.

Figure 10:
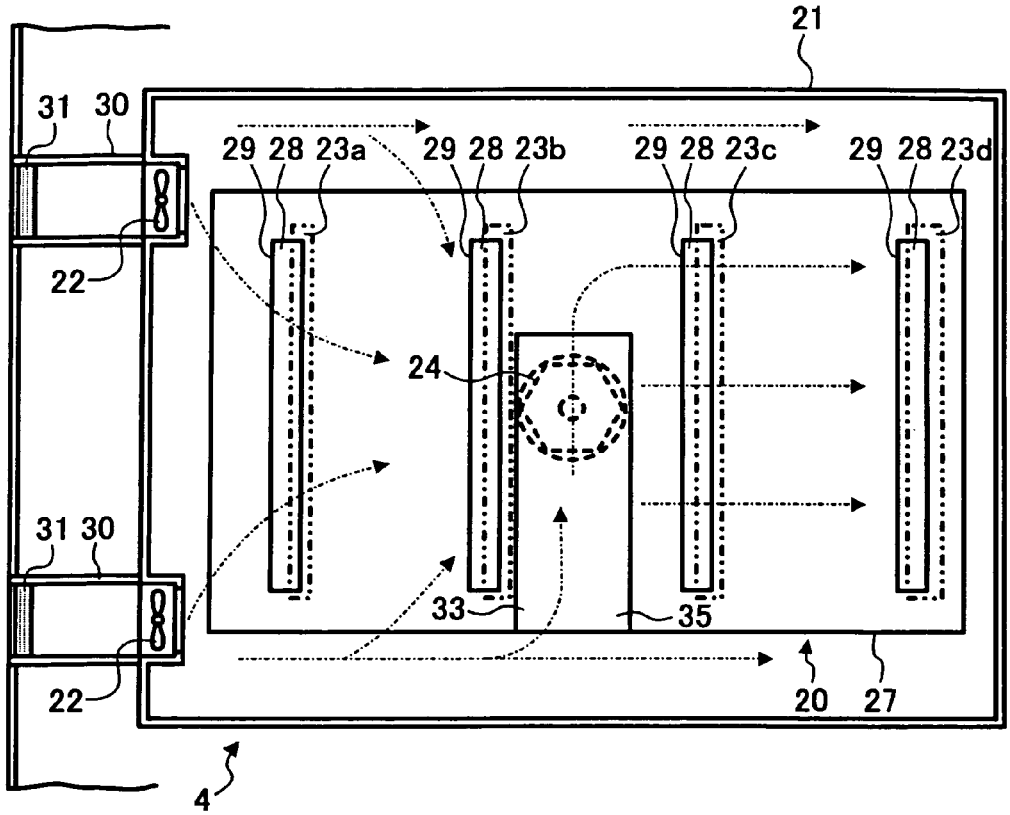
FIG. 10 is a plan view of the optical writing device of FIG. 9.

The air-intake path 30 is provided to communicate the outside of the main body 2 of the color printer 1*c* to the inside of the outer case 21. The air supplying device 22 is disposed at the position in the outer case 21 where the air-intake path 30 is connected to the outer case 21. The outside air is taken into the outer case 21 through the air-intake path 30 by driving the air supplying device 22. FIG. 10 is a plan view of the optical writing device 4 of FIG. 9. As illustrated in FIG. 10, two pairs of the air-intake path 30 and the air supplying device 22 are disposed in the vicinity of both end sides of the slit opening 23*a* in its longitudinal direction, respectively. Referring back to FIG. 9, the filter 31 for collecting dust is attached to the end portion of the air-intake path 30 which communicates with the outside of the main body 2. The filter 31 eliminates the powder dust in the air supplied into the outer case 21 by driving the air supplying device 22. The filter 31 is detachably attached into the air-intake path 30 for easy maintenance. The air supplied into the outer case 21 by driving the air supplying device 22 flows in a space formed between the inner peripheral surface of the outer case 21 and the outer peripheral surface of the inner case 27 as indicated by the arrows in FIG. 9. Further, as indicated by the arrows in FIG. 9, the air is discharged from the outer case 21 while being blown out from the slit openings 23*a*, 23*b*, 23*c*, and 23*d* disposed in the outer case 21.

As described above, the areas of the slit openings 23*a*, 23*b*, 23*c*, and 23*d* are different from each other. The area of the slit opening 23*a*, which is disposed on the most upstream side in a direction in which the air supplying device 22 supplies air into the outer case 21 (hereafter referred to as an "air supplying direction"), has the smallest cross sectional area as compared to the areas of the slit openings 23*b*, 23*c*, and 23*d*. The areas of the slit openings 23*b*, 23*c*, and 23*d* gradually increase as the positions of the slit openings 23*b*, 23*c*, and 23*d* are away from the air supplying device 22. If the areas of the slit openings 23*a*, 23*b*, 23*c*, and 23*d* are equal, a large amount of air can be blown out from the slit opening 23*a* disposed on the most upstream side in the air supplying direction, and an amount of air blown out from the slit opening 23*d* disposed on the downstream side in the air supplying direction can decrease, and the speed of the air blown out from the slit opening disposed on the downstream side in the air supplying direction, can be significantly reduced. If the speed of the air blown out from the slit opening is low, the scattered toner and powder dust floating in the main body 2 of the color printer 1*c* typically enter the outer case 21 through the slit opening. However, these problems can be prevented by gradually increasing the areas of the slit openings 23*a*, 23*b*, 23*c*, and 23*d* as the positions of the slit openings 23*a*, 23*b*, 23*c*, and 23*d* are away from the air supplying device 22. The areas of the slit openings 23*a*, 23*b*, 23*c*, and 23*d* are determined such that each speed of the air blown out from the slit openings 23*a*, 23*b*, 23*c*, and 23*d* becomes greater than or equal to a predetermined value, such as one meter/second. To change the areas of the slit openings 23*a*, 23*b*, 23*c*, and 23*d*, at least one of each width of the slit openings 23*a*, 23*b*, 23*c*, and 23*d* (i.e., the size in the direction in which the slit openings 23*a*, 23*b*, 23*c*, and 23*d* are disposed side by side) and each length of the slit openings 23*a*, 23*b*, 23*c*, and 23*d* (i.e., the size in the longitudinal direction of the slit openings 23*a*, 23*b*, 23*c*, and 23*d*) can be changed.

As illustrated in FIGS. 9 and 10, the airflow path 33 is formed at an outer peripheral portion of the inner case 27 to cool the polygon motor 25. The area in which the polygon motor 25 and the polygon mirror 24 are disposed in the inner case 27 is separated by the soundproof glasses 34 that allow a laser light beam to be transmitted therethrough. The airflow path 33 is formed by denting or deforming the upper portion of the inner case 27 above the area, and is disposed adjacent to the polygon motor 25.

The airflow path 33 is formed at the position where the air supplied into the outer case 21 by the air supplying device 22 flows toward the slit openings 23*c* and 23*d*. By passing the air supplied into the outer case 21 through the airflow path 33, the heat generated by rotating the polygon motor 25 at a relatively high speed, is released in the airflow. Thus, the air passing through the airflow path 33 facilitates cooling of the polygon motor 25.

Further, a portion of the airflow path 33 adjacent to the polygon motor 25 is formed from the metal plate 35 having high thermal conductivity. Therefore, the heat generated from the polygon motor 25 is preferably released from the metal plate 35 into the air passing through the airflow path 33, so that the polygon motor 25 is efficiently cooled.

In the above-described configuration of the optical writing device 4, the air outside of the main body 2 of the color printer 1*a* is supplied into the outer case 21 through the air-intake path 30 by driving the air supplying device 22 during image formation. The outside air contains significantly low amount of scattered toner and powder dust as compared to the air in the main body 2 of the color printer 1*c*. In addition, if powder dust is contained in the outside air, the filter 31 removes the powder dust before the outside air is supplied into the outer case 21. Thus, clean air can be supplied into the outer case 21, and powder dust can be prevented from entering the outer case 21.

When the air outside of the main body 2 of the color printer 1*c* is supplied into the outer case 21 by driving the air supplying device 22, air pressure in the outer case 21 is increased. The air is supplied into the outer case 21 flows as indicated by the arrows in FIG. 9 and discharges from the outer case 21 while being blown out from the slit openings 23*a*, 23*b*, 23*c*, and 23*d*. As described above, the area of the slit opening 23*a* disposed on the most upstream side in the air supplying direction is determined to be a minimum. Further, the areas of the slit openings 23*b*, 23*c*, and 23*d* gradually increase as the positions of the slit openings 23*b*, 23*c*, and 23*d* are away from the air supplying device 22. By adjusting the areas of the slit openings 23*a*, 23*b*, 23*c*, and 23*d* as above, each speed of the air blown out from the slit openings 23*a*, 23*b*, 23*c*, and 23*d* becomes greater than or equal to a predetermined value. By blowing air out from each of the slit openings 23*a*, 23*b*, 23*c*, and 23*d* at or greater than a predetermined speed, the scattered toner and powder dust floating in the main body 2 of the color printer 1*c* can be prevented from entering the outer case 21 through the slit openings 23*a*, 23*b*, 23*c*, and 23*d*. Accordingly, the scattered toner and powder dust can be prevented from adhering to the dust-proof glasses 29 provided in the inner case 27. As a result, the deterioration of image quality caused by scattered toner and powder dust adhered to the dust-proof glasses 29 can be minimized or avoided.

In this embodiment, as a non-limiting example, two air supplying devices 22 are provided in the optical writing device 4. Alternatively, the number of the air supplying device 22 can be one or greater than two.

Further, in this embodiment, the areas of the slit openings 23*a*, 23*b*, 23*c*, and 23*d* are different from each other. Alternatively, the slit openings 23*a*, 23*b*, 23*c*, and 23*d* can be formed to have at least two different sizes of areas such that each speed of air blown out from the slit openings 23*a*, 23*b*, 23*c*, and 23*d* becomes greater than or equal to a predetermined value. For example, the areas of the slit openings 23*a* and 23*b* disposed on the upstream side in the air supplying direction can be equal, and the areas of the slit openings 23*c* and 23*d* disposed on the downstream side in the air supplying direction can be equal. Further, the areas of the slit openings 23*c* and 23*d* can be greater than the areas of the slit openings 23*a* and 23*b*. Alternatively, the areas of the slit openings 23*a*, 23*b*, and 23*c* disposed on the upstream side in the air supplying direction can be equal, and the area of the slit opening 23*d* disposed on the downstream side in the air supplying direction can be greater than the areas of the slit openings 23*a*, 23*b*, and 23*c*. Moreover, the areas of the slit openings 23*b*, 23*c*, and 23*d* disposed on the downstream side in the air supplying direction can be equal, and the area of the slit opening 23*a* disposed on the upstream side in the air supplying direction can be relatively less than the areas of the slit openings 23*b*, 23*c*, and 23*d*.

Figure 11:
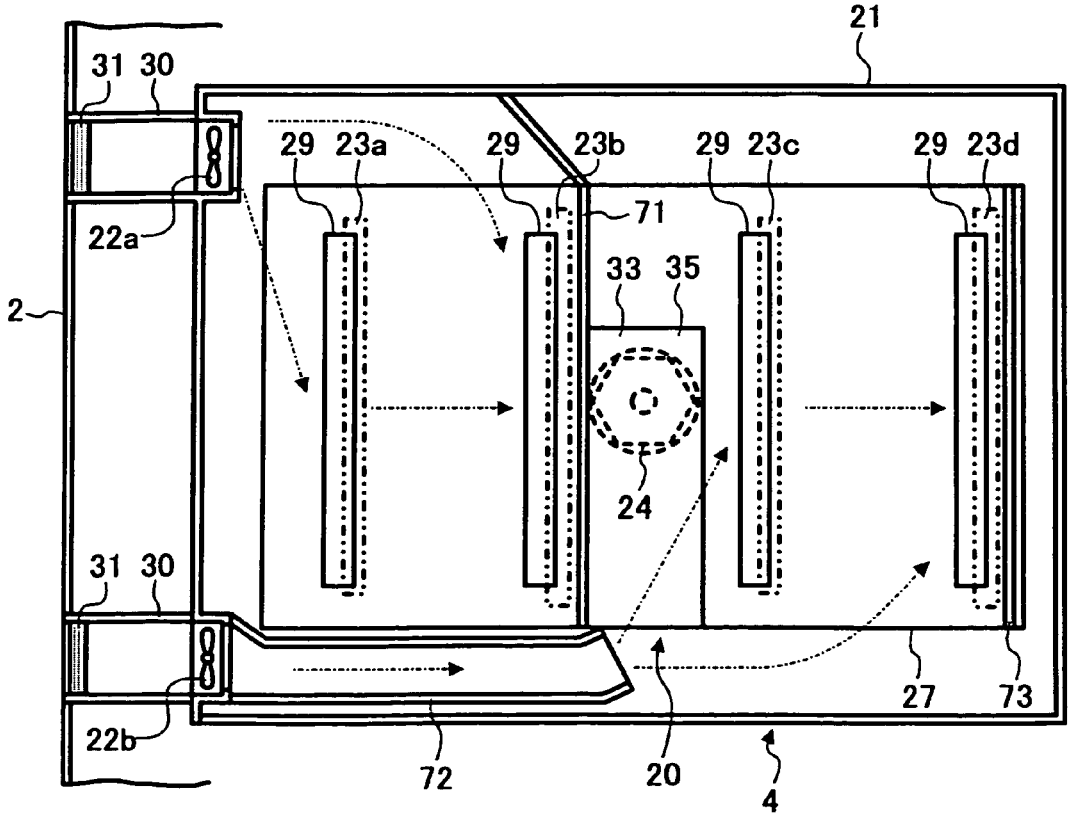
FIG. 11 is a plan view of an optical writing device according to another embodiment of the present invention.

Next, an optical writing device according to another embodiment of the present invention is described with reference to FIG. 11. Similar to the optical writing device 4 of FIGS. 9 and 10, the optical writing device 4 of FIG. 11 includes two air supplying devices 22*a* and 22*b*. It is configured that the air supplied from the air supplying device 22*a* into the outer case 21 is blown out from the two slit openings 23*a* and 23*b*, and the air supplied from the air supplying device 22*b* into the outer case 21 is blown out from the two slit openings 23*c* and 23*d*.

Further, a plate-shaped air supplying guide 71 is disposed in the optical writing device 4 such that the space between the inner surface of the outer case 21 and the outer surface of the inner case 27 is partitioned with the air supplying guide 71. The air supplying guide 71 directs the air supplied from the air supplying device 22*a* to the slit openings 23*a* and 23*b*. Moreover, air supplying guides 72 and 73 are provided in the optical writing device 4 to direct the air supplied from the air supplying device 22*b* to the slit openings 23*c* and 23*d*. The air supplying guide 72 is a duct-shaped member, and the air supplying guide 73 is a plate-shaped member disposed such that the space between the inner surface of the outer case 21 and the outer surface of the inner case 27 is partitioned with the air supplying guide 73.

As described above, the air supplied from the air supplying device 22*a* is blown out from the slit openings 23*a* and 23*b*. The area of the slit opening 23*a* disposed on the upstream side in the air supplying direction relative to the slit opening 23*b* is relatively small, and the area of the slit opening 23*b* disposed on the downstream side in the air supplying direction relative to the slit opening 23*a* is relatively large. In addition, the areas of the slit openings 23*a* and 23*b* are adjusted such that each speed of air blown out from the slit openings 23*a* and 23*b* is greater than or equal to a predetermined value. Alternatively, the areas of the slit openings 23*a* and 23*b* can be equal so long as each speed of air blown out from the slit openings 23*a* and 23*b* is greater than or equal to a predetermined value.

Further, as described above, the air supplied from the air supplying device 22*b* is blown out from the slit openings 23*c* and 23*d*. The area of the slit opening 23*c* disposed on the upstream side in the air supplying direction relative to the slit opening 23*d* is relatively small, and the area of the slit opening 23*d* disposed on the downstream side in the air supplying direction relative to the slit opening 23*c* is relatively large. In addition, the areas of the slit openings 23*c* and 23*d* are adjusted such that each speed of air blown out from the slit openings 23*c* and 23*d* is greater than or equal to a predetermined value. Alternatively, the areas of the slit openings 23*c* and 23*d* can be equal so long as each speed of air blown out from the slit openings 23*c* and 23*d* is greater than or equal to a predetermined value.

With the air supplying guides 71, 72, and 73, the air supplied from the air supplying device 22*a* can be blown out from the slit openings 23*a* and 23*b* with accuracy, and the air supplied from the air supplying device 22*b* can be blown out from the slit openings 23*c* and 23*d* with accuracy. Thus, each speed of air blown out from the slit openings 23*a*, 23*b*, 23*c*, and 23*d* can be accurately maintained greater than or equal to a predetermined value. Further, because an air supplying device need not be provided to each of the slit openings 23*a*, 23*b*, 23*c*, and 23*d*, that is, the number of air supplying devices can be less than the number of the slit openings 23*a*, 23*b*, 23*c*, and 23*d*, the cost of the optical writing device can be reduced.

Figure 12:
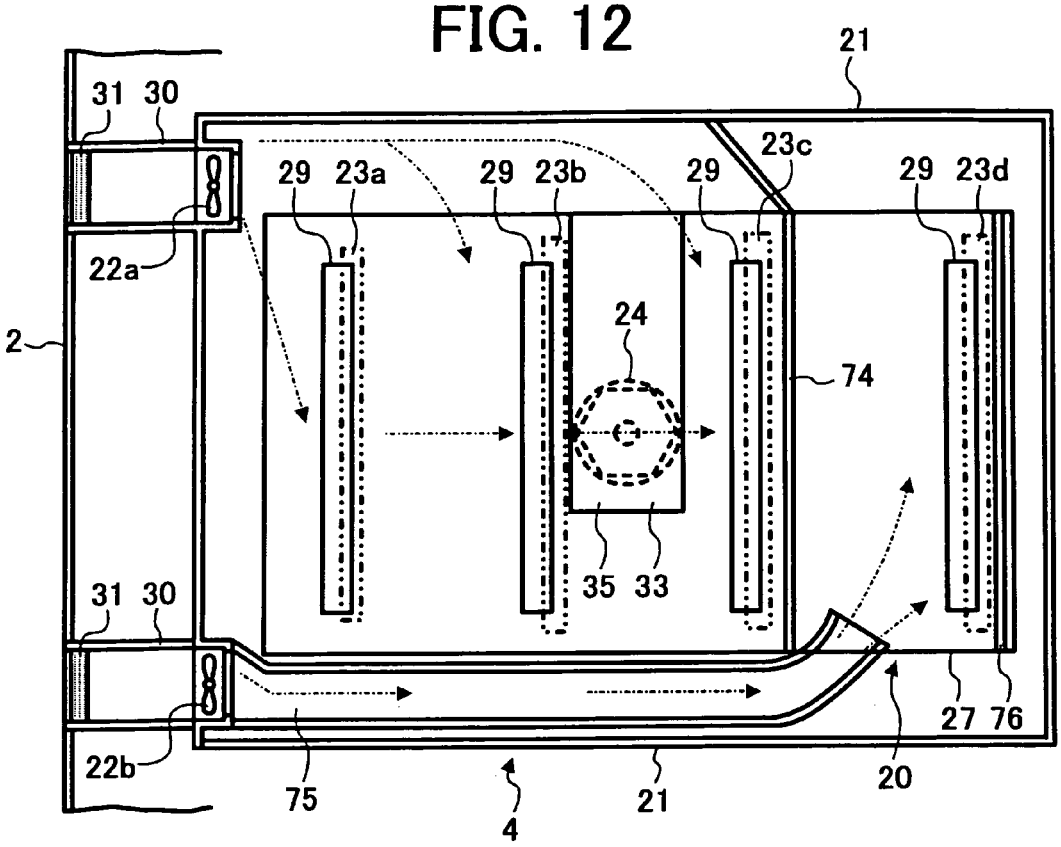
FIG. 12 is a plan view of an optical writing device according to another embodiment of the present invention.

Next, an optical writing device according to another embodiment of the present invention is described with reference to FIG. 12. Similar to the optical writing device 4 of FIGS. 9 and 10, the optical writing device 4 of FIG. 12 includes two air supplying devices 22*a* and 22*b* that supply air into the outer case 21. It is configured that the air supplied from the air supplying device 22*a* into the outer case 21 is blown out from the three slit openings 23*a*, 23*b*, and 23*c*, and the air supplied from the air supplying device 22*b* into the outer case 21 is blown out from the slit opening 23*d*.

Further, a plate-shaped air supplying guide 74 is disposed in the optical writing device 4 such that the space between the inner surface of the outer case 21 and the outer surface of the inner case 27 is partitioned with the air supplying guide 74. The air supplying guide 74 directs the air supplied from the air supplying device 22*a* to the slit openings 23*a*, 23*b* and 23*c*. Moreover, air supplying guides 75 and 76 are provided in the optical writing device 4 to direct the air supplied from the air supplying device 22*b* to the slit opening 23*d*. The air supplying guide 75 is a duct-shaped member, and the air supplying guide 76 is a plate-shaped member disposed such that the space between the inner surface of the outer case 21 and the outer surface of the inner case 27 is partitioned with the air supplying guide 76.

As described above, the air supplied from the air supplying device 22*a* is blown out from the slit openings 23*a*, 23*b*, and 23*c*. The area of the slit opening 23*a* disposed on the upstream side in the air supplying direction relative to the slit openings 23*b* and 23*c* is relatively small, and the area of the slit opening 23*b* is greater than that of the slit opening 23*a*, and the area of the slit opening 23*c* is greater than that of the slit opening 23*b*. In addition, the areas of the slit openings 23*a*, 23*b* and 23*c* are adjusted such that each speed of air blown out from the slit openings 23*a*, 23*b* and 23*c* is greater than or equal to a predetermined value. Alternatively, the areas of the slit openings 23*a*, 23*b* and 23*c* can be equal so long as each speed of air blown out from the slit openings 23*a*, 23*b* and 23*c* is greater than or equal to a predetermined value.

Further, as described above, the air supplied from the air supplying device 22*b* is blown out from the slit opening 23*d*. The area of the slit opening 23*d* is substantially greater than or equal to that of the slit opening 23*c*. In addition, the area of the slit opening 23*d* is adjusted such that the speed of air blown out from the slit opening 23*d* is greater than or equal to a predetermined value.

With the air supplying guides 74, 75, and 76, the air supplied from the air supplying device 22*a* can be blown out from the slit openings 23*a*, 23*b*, and 23*c* with accuracy, and the air supplied from the air supplying device 22*b* can be blown out from the slit opening 23*d* with accuracy. Thus, each speed of air blown out from the slit openings 23*a*, 23*b*, 23*c*, and 23*d* can be accurately maintained greater than or equal to a predetermined value. Further, because an air supplying device need not be provided to each of the slit openings 23*a*, 23*b*, 23*c*, and 23*d*, that is, the number of air supplying devices can be less than the number of the slit openings 23*a*, 23*b*, 23*c*, and 23*d*, the cost of the optical writing device can be reduced.

Next, an optical writing device according to another embodiment of the present invention is described with reference to FIG. 13. An optical writing device 81 of FIG. 13 includes the optical writing unit 20 that emits a laser light beam for writing, the outer case 21 that accommodates the optical writing unit 20, the air supplying devices 22 that supply air into the outer case 21, and the air-intake paths 30 through which outside air is taken into the outer case 21 by driving the air supplying devices 22.

Figure 13:
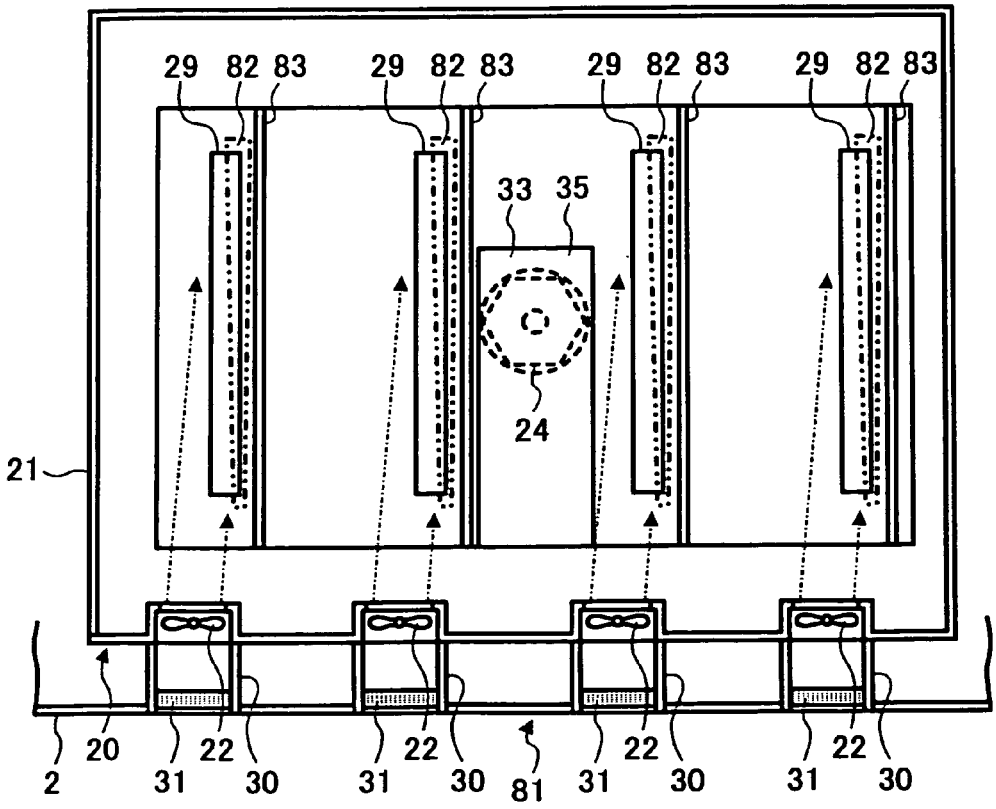
FIG. 13 is a plan view of an optical writing device according to another embodiment of the present invention.

As illustrated in FIG. 13, four slit openings 82 are disposed in the upper surface portion of the outer case 21 through which laser light beams are permitted to pass. The slit openings 82 are disposed parallel to the axial direction of the photoreceptors 10 side by side. Four air supplying devices 22 are provided corresponding to the four slit openings 82, respectively. Each air supplying device 22 is disposed at one end side of each of the slit openings 82 in its longitudinal direction. Further, a plurality of air supplying guides 83 are provided in the outer case 21. The air supplying guides 83 direct air supplied from the air supplying devices 22 to the slit openings 82, respectively. Each of the air supplying guides 83 is formed from a plate member and a space between the inner surface of the outer case 21 and the outer surface of the inner case 27 is partitioned with the air supplying guides 83.

The width of the slit openings 82 disposed at the position closest to the air supplying device 22 is smallest. The width of the slit openings 82 gradually increases as the slit openings 82 is disposed farther away from the air supplying device 22.

In the above-described configuration of the optical writing device 81, the air outside of the main body 2 of the color printer 1*c* is supplied into the outer case 21 through the air-intake path 30 by driving the air supplying devices 22 during image formation. The air is supplied into the outer case 21 flows as indicated by the arrows in FIG. 13 and discharges from the outer case 21 while being blown out from the slit openings 82. In this embodiment, air is blown out from each of the slit openings 82 greater than or equal to a predetermined speed, thereby preventing scattered toner and powder dust floating in the main body 2 of the color printer 1*c* from entering the outer case 21 through the slit openings 82. Further, because the air supplying guides 83 are provided and function as partition members that separate the slit openings 82 from each other, each speed of air blown out from the slit openings 82 can be accurately maintained greater than or equal to a predetermined value.

As described above, the width of each of the slit openings 82 gradually increases as the position of each of the slit openings 82 is away from the air supplying device 22. With these slit openings 82, occurrences of the following problems are minimized or avoided, for example: (1) a large amount of air blows out from the portion of the slit opening 82 disposed adjacent to the air supplying device 22, and an amount of air blown out from the portion of the slit opening 82 disposed at the position away from the air supplying device 22 significantly decreases; and (2) the speed of air blown out from the portion of the slit opening 82 disposed adjacent to the air supplying device 22 increases, and the speed of air blown out from the portion of the slit opening 82 disposed at the position away from the air supplying device 22 decreases. If the speed of air blown out from the slit opening 82 is relatively low, the scattered toner and powder dust floating in the main body 2 of the color printer 1*c* can easily enter the outer case 21.

In the optical writing device 4 of the present embodiment, each speed of air blown out from the slit openings 82 in the entire area in the longitudinal direction of the slit openings 82 can be accurately maintained greater than or equal to a predetermined value. As a result, scattered toner and powder dust can be prevented from entering the outer case 21 through the slit openings 82.

Figure 14:
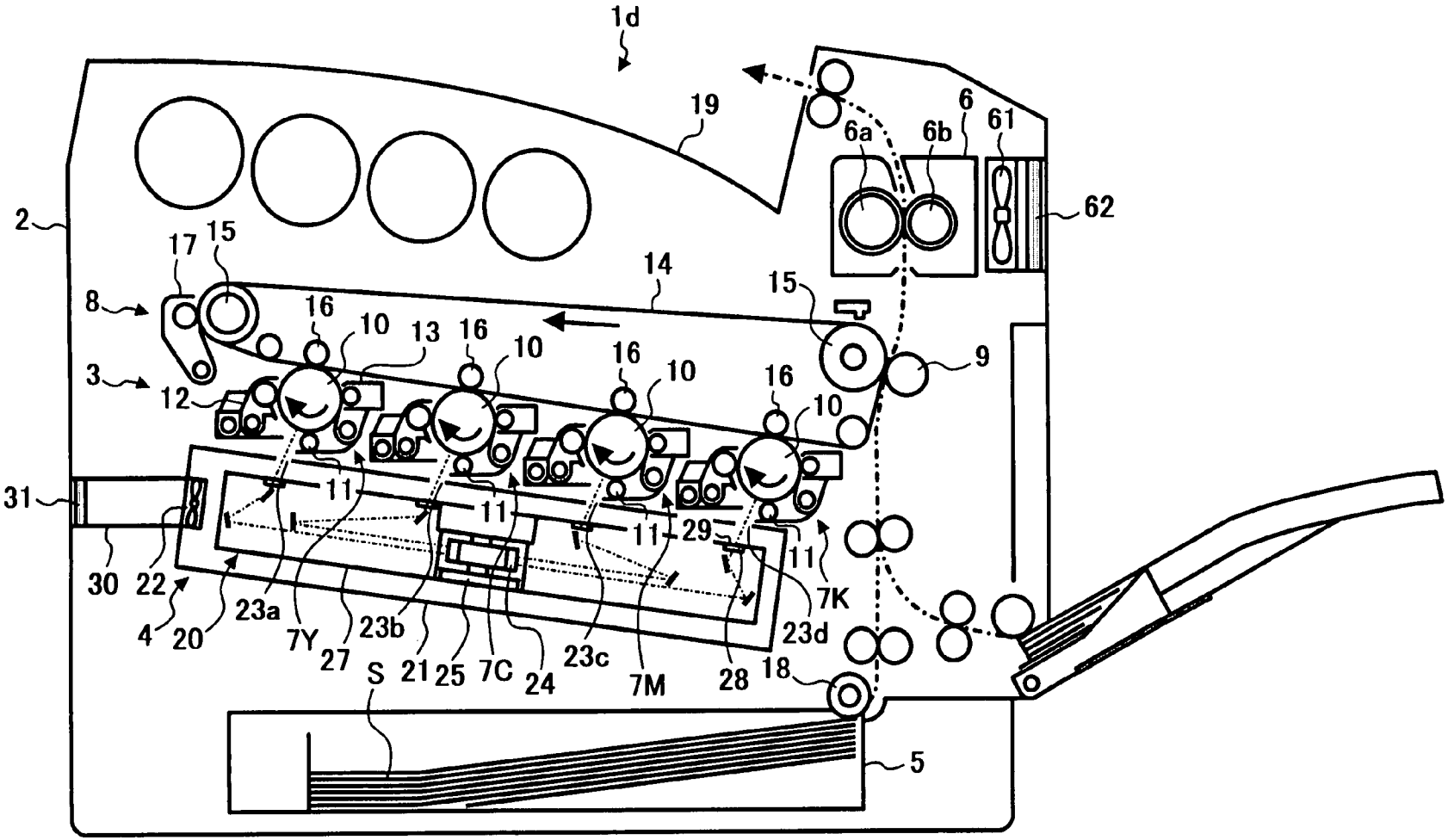
FIG. 14 is a side view of a color printer according to another embodiment of the present invention.

Next, a color printer including an optical writing device according to another embodiment of the present invention is described with reference to FIG. 14. FIG. 14 is a side view of a color printer 1*d* according to another embodiment of the present invention. The configuration of the color printer 1*d* of FIG. 14 is similar to that of the color printer 1*c* of FIG. 8 except that the color printer 1*d* of FIG. 14 includes the fan 61 acting as an air exhaust device, and the filter 62 in the main body 2. The air outside of the outer case 21 is exhausted from the main body 2 by driving the fan 61. The filter 62 collects scattered toner and powder dust contained in the air exhausted from the main body 2.

In the color printer 1*d*, the air pressure outside of the outer case 21 in the main body 2 becomes lower than the atmospheric pressure by driving the fan 61 during image formation. As a result, the air supplied into the outer case 21 blows out from the slit openings 23*a*, 23*b*, 23*c*, and 23*d* at a high speed, and thereby scattered toner and powder dust are significantly prevented from entering the outer case 21 through the slit openings 23*a*, 23*b*, 23*c*, and 23*d*. Thus, the deterioration of image quality caused by scattered toner and powder dust entered into the outer case 21 can be minimized or avoided.

Further, because the filter 62 collects scattered toner and powder dust floating in the main body 2 by driving the fan 61, scattered toner and powder dust can be prevented from entering the outer case 21 through the slit openings 23*a*, 23*b*, 23*c*, and 23*d*.

In the above-described embodiments of the present invention, as non-limiting examples, the air supplying device 22 can employ a fan, a bellows pump, and a moineau pump. By using a fan, a bellows pump, and a moineau pump, air can be supplied into the outer case 21 with a compact configuration. In the bellows pump, a bellows expansion element is expanded and contracted by driving a motor. Air is sucked in and exhausted from the bellows expansion element by expanding and contracting the bellows expansion element. The air exhausted from the bellows expansion element is supplied into the outer case 21. In the moineau pump, a rotor is rotated in a cylindrical element by driving a motor. Air is sucked in from one end side of the cylindrical element and is exhausted from another end side of the cylindrical element by rotating the rotor. The air exhausted from the cylindrical element is supplied into the outer case 21.

Figure 15:
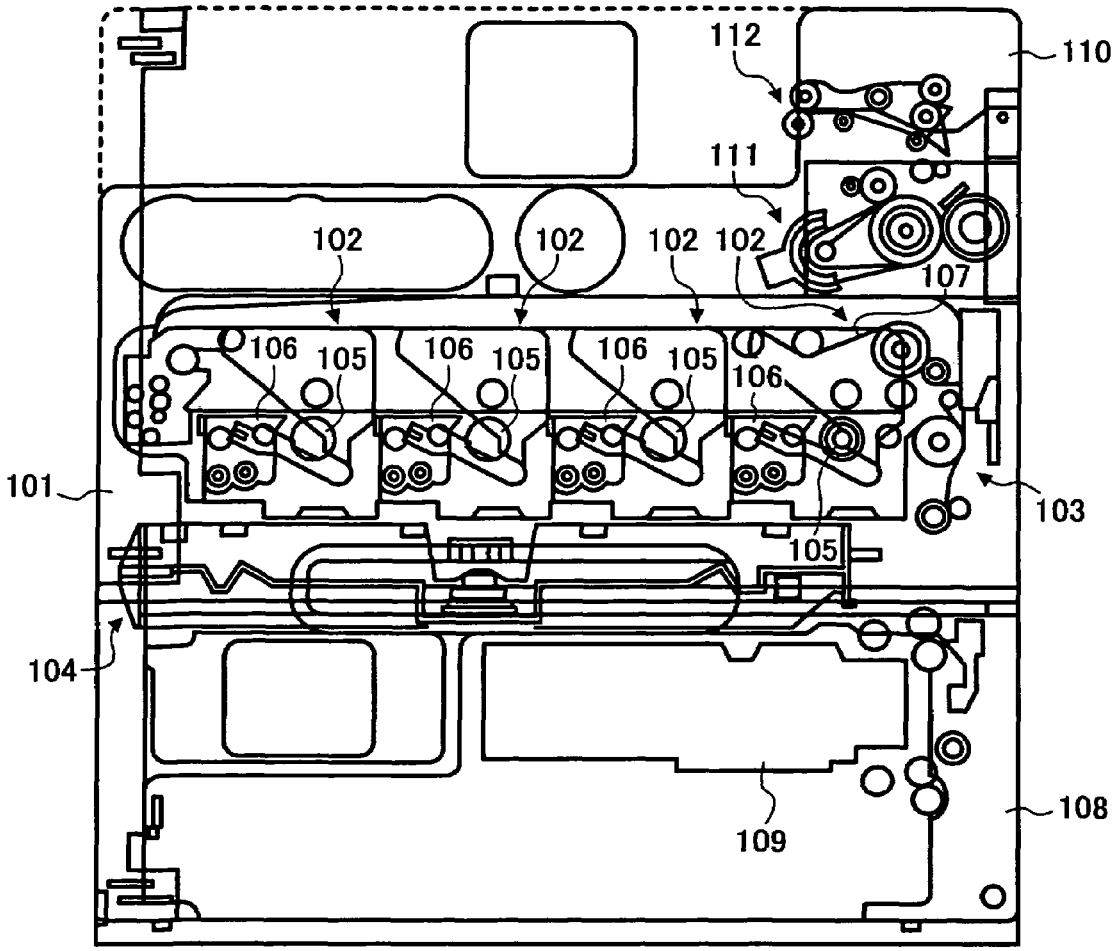
FIG. 15 is a schematic cross sectional view of a color printer according to another embodiment of the present invention.
Figure 16:
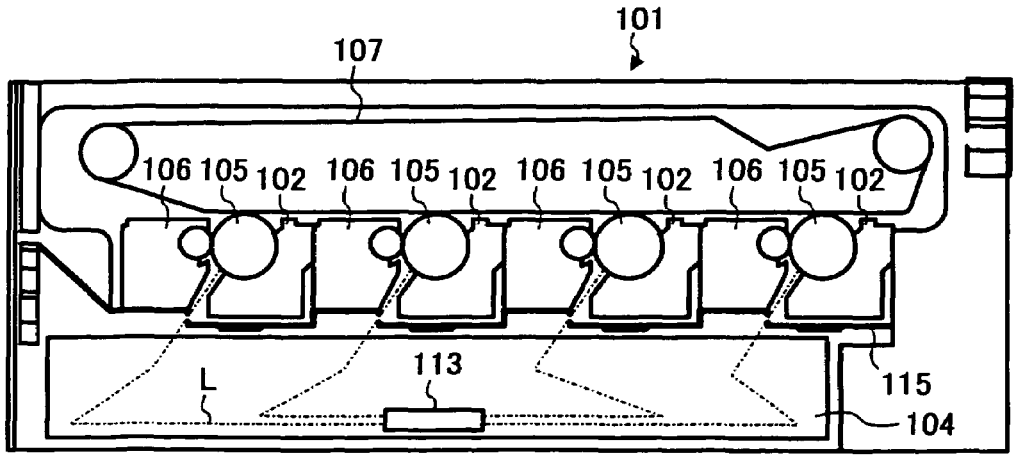
FIG. 16 is a schematic cross sectional view of an image forming section of the color printer of FIG. 15.

Next, an image forming apparatus according to another embodiment of the present invention is described. FIG. 15 is a schematic cross sectional view of a color printer as an example of an image forming apparatus. FIG. 16 is a schematic cross sectional view of an image forming section of the color printer of FIG. 15.

The color printer of FIG. 15 includes an image forming section 101 as a main body. The image forming section 101 includes four photoconductor units 102 used for forming toner images of different colors, a transfer device 103, and an optical writing device 104. Each of the photoconductor units 102 includes a photoreceptor 105 acting as an image carrier configured to carry a latent image. The image forming section 101 further includes developing units 106 provided to the photoconductor units 102, respectively, and an intermediate transfer belt 107. The color printer of FIG. 15 further includes a sheet feeding section 108 having a sheet feeding cassette 109. The color printer of FIG. 15 further includes a fixing and sheet discharging section 110 having a fixing device 111 and a sheet discharging device 112. In this color printer, a color image is formed and transferred onto a sheet fed from the sheet feeding cassette 109 in the image forming section 101. The transferred color image is fixed onto the sheet by the fixing device 111. Subsequently, the sheet having the color image is discharged from the color printer by the sheet discharging device 112. Because a configuration and operation of a color image forming apparatus for forming color images are well known, portions of the description are omitted.

As illustrated in FIG. 16, in the image forming section 101, the optical writing device 104 is disposed below the photoconductors 105 in the photoconductor units 102, and a partition member 115 is interposed between the photoconductor units 102 and the optical writing device 104. The dotted lines denoted by a reference character "L" indicate a light path of a laser light beam emitted from the optical writing device 104 (referred to as a laser light beam "L").

Figure 17A:
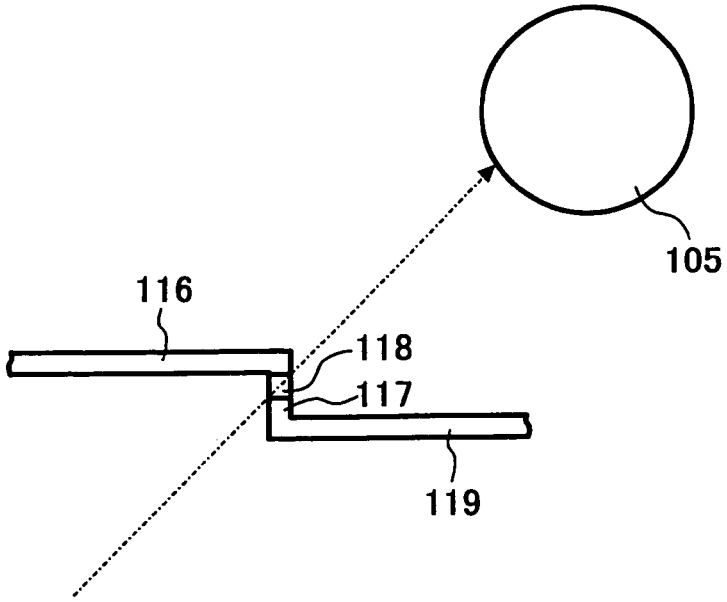
FIG. 17A is a cross sectional view of a partition member.
Figure 17B:
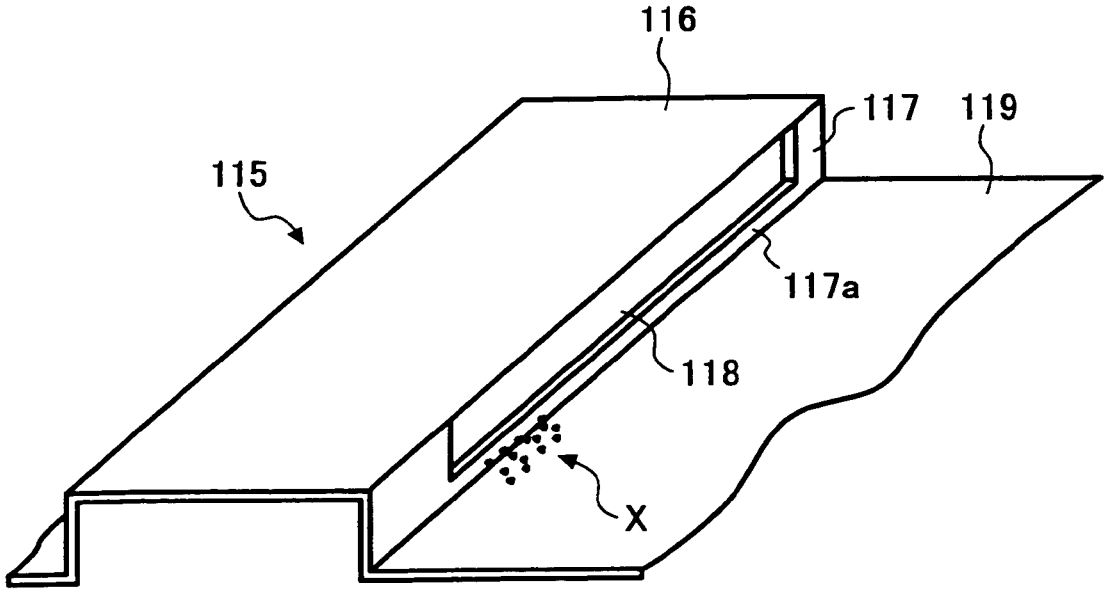
FIG. 17B is a perspective view of the partition member of FIG. 17A.

FIG. 17A is a cross sectional view of the partition member 115, and FIG. 17B is a perspective view of the partition member 115 of FIG. 17A. The partition member 115 is formed by bending a plate member repeatedly at a substantially right angle, and has a convex and concave cross section. The partition member 115 includes an upper stepped surface 116, a lower stepped surface 119, and a pendent surface 117. The upper stepped surface 116 is disposed at the position between the two photoreceptor units 102, that is, below the developing unit 106. The pendent surface 117 extends downwardly from the upper stepped surface 116 to the lower stepped surface 119. The position of the pendent surface 117 corresponds to the position of the photoreceptor 105 to which a laser light beam "L" is directed from optical members 113, such as semiconductor lasers and a polygon mirror, of the optical writing device 104. Further, a slit opening 118 is disposed in the pendent surface 117 such that the slit opening 118 elongates along a scanning direction of the optical writing device 104. The optical writing device 104 emits the laser light beam "L" from the optical members 113 toward the surface of the photoreceptor 105 through the slit opening 118 to form a latent image thereon. The lower stepped surface 119 is disposed below the photoreceptor unit 102.

A reason for forming the slit opening 118 in the pendent surface 117 which extends from the upper stepped surface 116 along the up and down direction in the color printer is that the projected area of the slit opening 118 in a falling direction of toner and powder dust from the developing unit 106 and the photoreceptor 105 is minimized, in consideration of the possibility that toner and powder dust can fall from the developing unit 106 and the photoreceptor 105 when a latent image is written on the surface of the photoreceptor 105 with the laser light beam "L" emitted from lower side of the photoreceptor 105. By forming the slit opening 118 in the pendent surface 117 in a vertical direction, the toner and powder dust falling from the developing unit 106 and the photoreceptor 105 are minimized or prevented from entering the slit opening 118.

As illustrated in FIG. 17B, the lower edge of the slit opening 118 is disposed at a slightly upper side relative to the lower stepped surface 119 in the vertical direction. That is, a wall part 117*a* of the pendent surface 117 exists between the lower edge of the slit opening 118 and the lower stepped surface 119. The wall part 117*a* of the pendent surface 117 prevents scattered toner X deposited on the lower stepped surface 119 from entering the inner side of the upper stepped surface 116 (i.e., toward the optical writing device 104) through the slit opening 118.

Figure 18A:
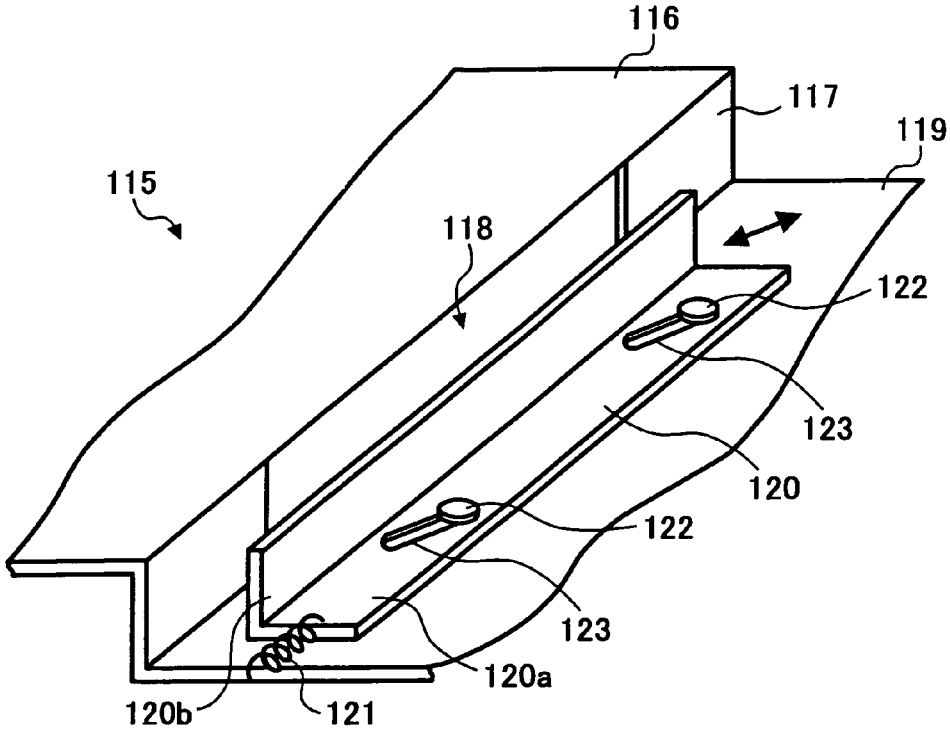
FIG. 18A is a perspective view of a shutter mechanism.
Figure 18B:
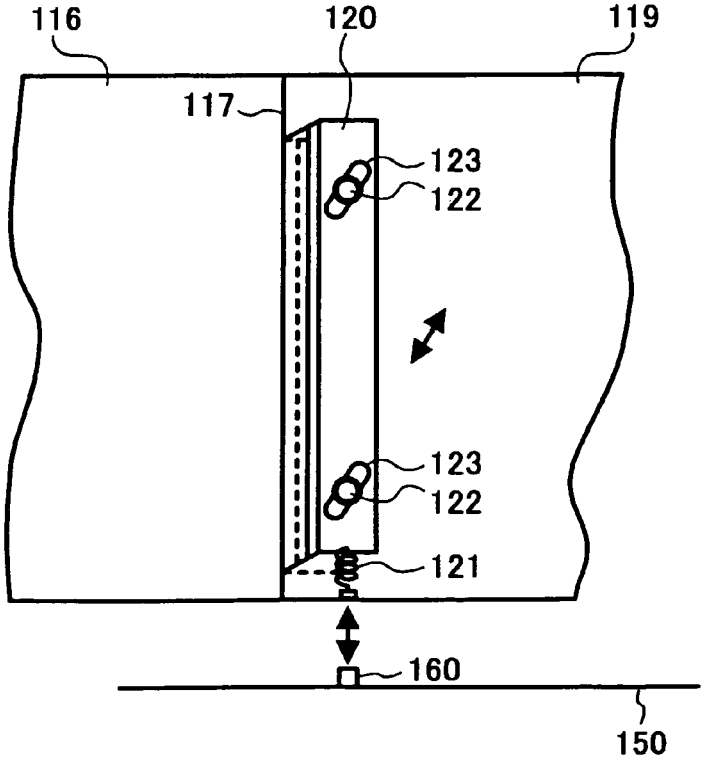
FIG. 18B is a top view of the shutter mechanism of FIG. 18A.

FIG. 18A is a perspective view of a shutter mechanism configured to open and close the slit opening 118, and FIG. 18B is a top view of the shutter mechanism of FIG. 18A. The shutter mechanism of the present embodiment includes a shutter member 120 having an L-shaped cross section and including a vertical portion 120*b* and a lateral portion 120*a*, a biasing member 121 (such as a spring) that biases the shutter member 120 toward the slit opening 118, and stepped screws 122 attaching the lateral portion 120*a* of the shutter member 120 onto the lower stepped surface 119 of the partition member 115.

As illustrated in FIGS. 18A and 18B, a pair of groove openings 123 is disposed slantwise in the lateral portion 120*a* of the shutter member 120 provided parallel to the lower stepped surface 119. By engaging the stepped screws 122 with the groove openings 123, the shutter member 120 is configured to contact and separate with and from the pendent surface 117 including the slit opening 118 by moving in parallel to and slantwise relative to the pendent surface 117 in the direction indicated by the arrows in FIGS. 18A and 18B.

The biasing member 121 always biases the shutter member 120 toward a front side in FIGS. 18A and 18B. Therefore, in the default position, the shutter member 120 closes the slit opening 118. The color printer of the present embodiment further includes a cover plate 150 disposed over the front side of the color printer to cover the image forming section 101 including the photoconductor units 102, the transfer device 103, the optical writing device 104, the developing units 106, and the intermediate transfer belt 107. The cover plate 150 is configured to cover and uncover the image forming section 101 by closing and opening the cover plate 150. A plurality of protruding members 160, such as ribs, is provided on the inner side of the cover plate 150. Referring to FIG. 18B, when the cover plate 150 is closed, the protruding member 160 contacts and presses the biasing member 121 from the front side to the rear side in FIG. 18B, and thereby the shutter member 120 moves backward in a direction away from the slit opening 118. As a result, the slit opening 118 opens. When the cover plate 150 is opened, the protruding member 160 moves from the rear side to the front side in FIG. 18B, and thereby the shutter member 120 moves forward in a direction approaching and contacting the slit opening 118. By this arrangement, the slit opening 118 is closed with the shutter member 120. Accordingly, the cover plate 150 and the protruding member 160 act as a drive device configured to drive the shutter mechanism to move to open and close the slit opening 118. In this configuration, when the cover plate 150 is opened to remove the photoreceptor 105 in the photoconductor unit 102 from the image forming section 101 for replacement, the shutter member 120 closes the slit opening 118. Accordingly, the scattered toner and powder dust falling from the photoreceptor 105 can be prevented from entering the slit opening 118.

Figure 19:
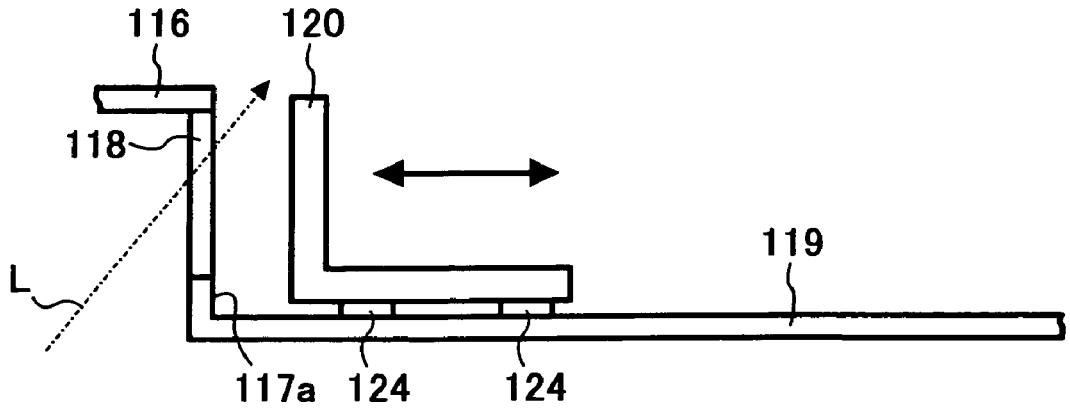
FIG. 19 is a cross sectional view of the partition member and a shutter member according to another embodiment of the present invention.

FIG. 19 is a cross sectional view of the partition member 115 and the shutter member 120 according to another embodiment of the present invention. As illustrated in FIG. 19, a plurality of convex portions 124 is provided on the lower surface of the shutter member 120. The convex portions 124 slidably contact the lower stepped surface 119 of the partition member 115. The convex portions 124 minimize the contact of the lower surface of the shutter member 120 with scattered toner deposited on the lower stepped surface 119. The convex portions 124 prevents the scattered toner from entering the slit opening 118. Further, because the contact area between the shutter member 120 and the lower stepped surface 119 decreases by providing the convex portions 124, sliding-contact resistance can be reduced when the shutter member 120 slides on the lower stepped surface 119. Accordingly, the shutter member 120 can smoothly slide on the lower stepped surface 119. To determine the lower surface of the shutter member 120, the convex portions 124 need to be provided at at least three positions. In the case of forming the shutter member 120 by a plate metal processing, the convex portions 124 can be easily formed by a half blanking processing.

Figure 20:
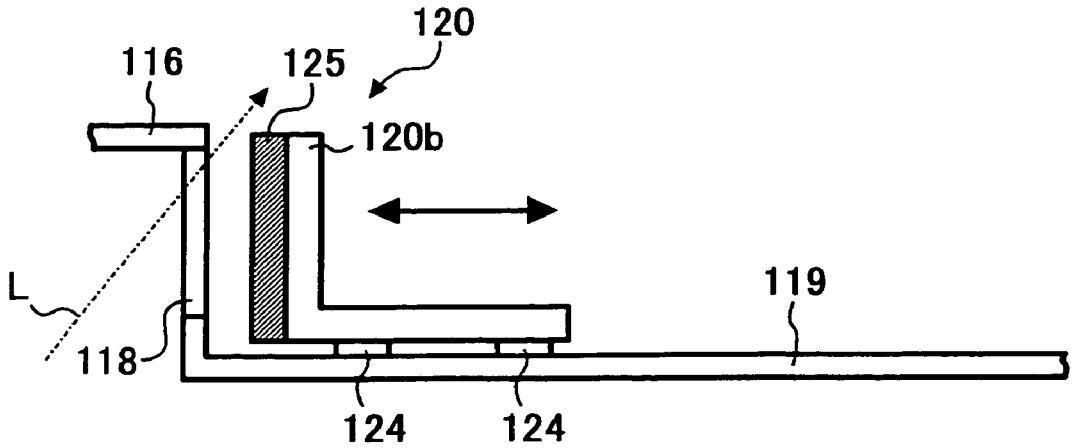
FIG. 20 is a cross sectional view of the partition member and the shutter member according to another embodiment of the present invention.

FIG. 20 is a cross sectional view of the partition member 115 and the shutter member 120 according to another embodiment of the present invention. In this embodiment, an elastic member 125 is attached onto a surface of the vertical portion 120*b* of the shutter member 120 facing or opposing the slit opening 118. When the shutter member 120 closes the slit opening 118, the slit opening 118 can be sealed with the elastic member 125. Accordingly, scattered toner is effectively prevented from entering the slit opening 118. As an alternative to the attachment of the elastic member 125 to the shutter member 120, the shutter member 120 can be integrally formed from resin and an elastomer. In this case, material and labor costs can be reduced as compared to a manual attachment of the elastic member 125 to the shutter member 120.

Figure 21:
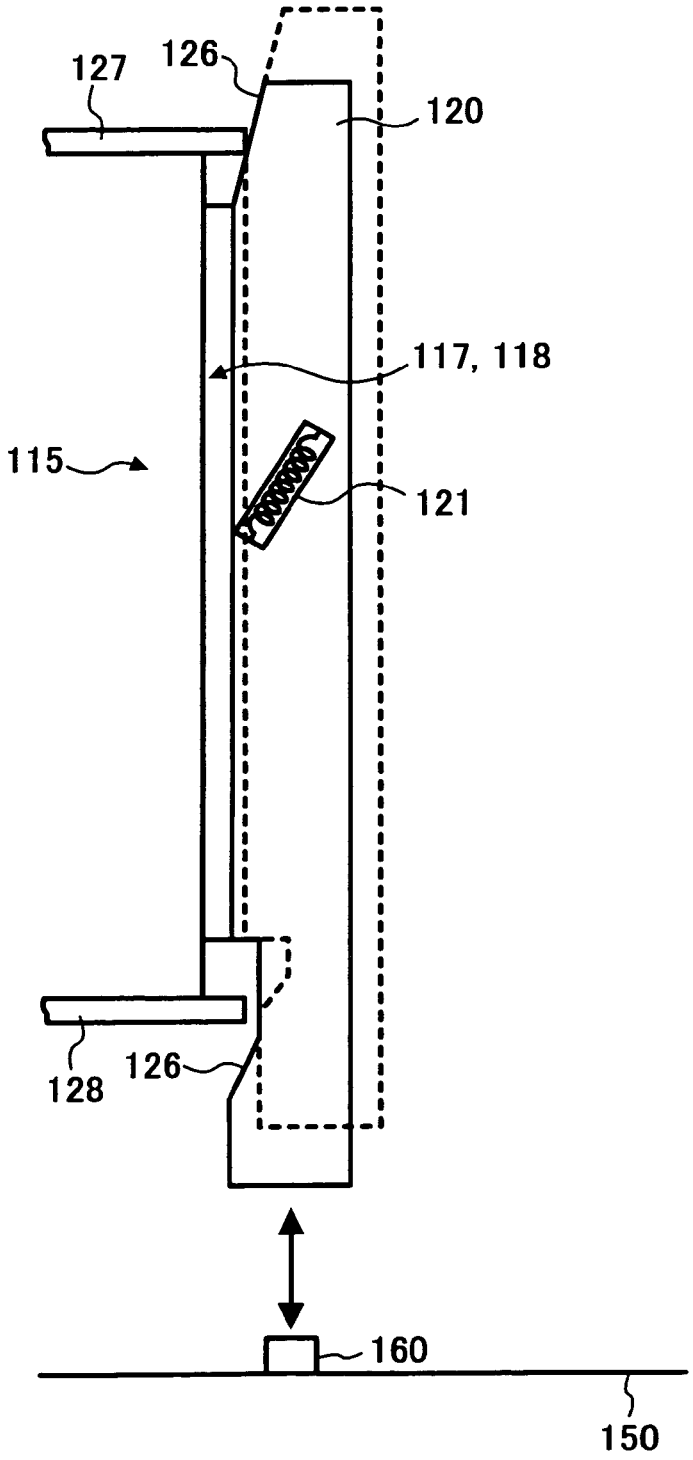
FIG. 21 is a top view of the shutter mechanism according to another embodiment of the present invention.

FIG. 21 is a top view of the shutter mechanism according to another embodiment of the present invention. As illustrated in FIG. 21, the shutter member 120 includes front and rear cam surfaces 126 on the front and rear sides in FIG. 21, respectively. In this embodiment, a side plate 127 of the color printer which is disposed on the rear side of the partition member 115 slidably contacts the rear cam surface 126. The biasing member 121 is interposed slantwise between the shutter member 120 and the lower stepped surface 119 of the partition member 115. Similarly as in the shutter mechanism and the drive device described referring to FIG. 18B, when the cover plate 150 is closed, the protruding member 160 contacts and presses the shutter member 120 from the front side to the rear side in FIG. 21, and thereby the shutter member 120 moves backward in a direction away from the slit opening 118 by sliding the rear cam surface 126 relative to the side plate 127. As a result, the slit opening 118 opens. When the cover plate 150 is opened, the protruding member 160 moves from the rear side to the front side in FIG. 21, and thereby the shutter member 120 moves forward in a direction approaching and contacting the slit opening 118 by sliding the rear cam surface 126 relative to the side plate 127. As a result, the slit opening 118 is closed with the shutter member 120. In this configuration, because the shutter member 120 can contact and separate with and from the slit opening 118 by using a simple configuration, such as the rear cam surface 126 and the side plate 127, the cost of the color printer can be reduced as compared to the configuration using the stepped screws 122. In another embodiment of the invention, the front cam surface 126 can slidably contact a side plate 128 of the color printer. Further, both the front and rear cam surfaces 126 can slidably contact the side plates 128 and 127, respectively.

Figure 22:
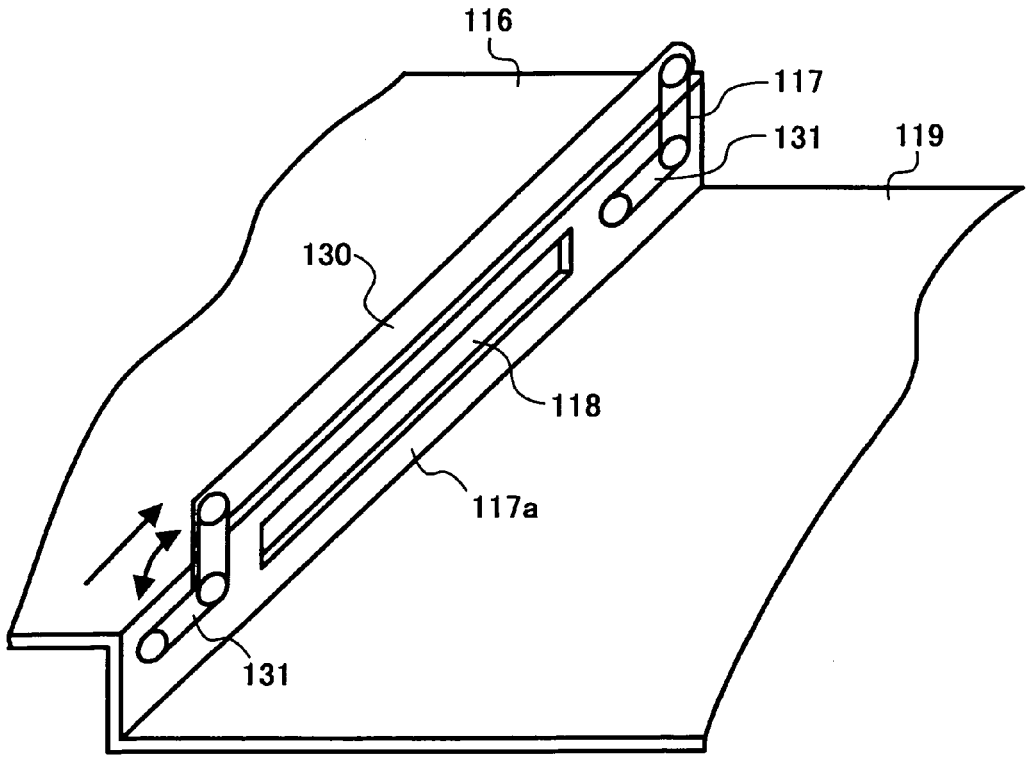
FIG. 22 is a perspective view of the shutter mechanism according to another embodiment of the present invention.

FIG. 22 is a perspective view of the shutter mechanism according to another embodiment of the present invention. The shutter mechanism of FIG. 22 includes a plated-shaped shutter member 130, and a pair of link members 131 attached to the both end portions of the shutter member 130, respectively, to support the shutter member 130. Specifically, one end portion of the link member 131 is attached to one end portion of the shutter member 130, and the other end portion of the link member 131 is attached onto the pendent surface 117. Alternatively, the other end portion of the link member 131 can be attached to a member in the image forming section 101 of the color printer. The shutter mechanism further includes a biasing device (not shown), such as a spring, that always biases the shutter member 130 toward the slit opening 118. Therefore, in the default position, the shutter member 130 closes the slit opening 118. Although an illustration is omitted here, when the cover plate 150 is closed, the protruding member 160 contacts and presses the biasing member of the shutter mechanism of FIG. 22, and thereby the shutter member 130 rotates upward in parallel to the slit opening 118 in a direction away from the slit opening 118. As a result, the slit opening 118 opens. When the cover plate 150 is opened, the protruding member 160 moves from the rear side to the front side in FIG. 22, and thereby the shutter member 130 rotates downward in parallel to the slit opening 118 in a direction approaching and contacting the slit opening 118. As a result, the slit opening 118 is closed with the shutter member 130. This configuration is effective especially when there is no enough space for disposing a shutter member on the lower stepped surface 119 of the partition member 115.

Figure 23:
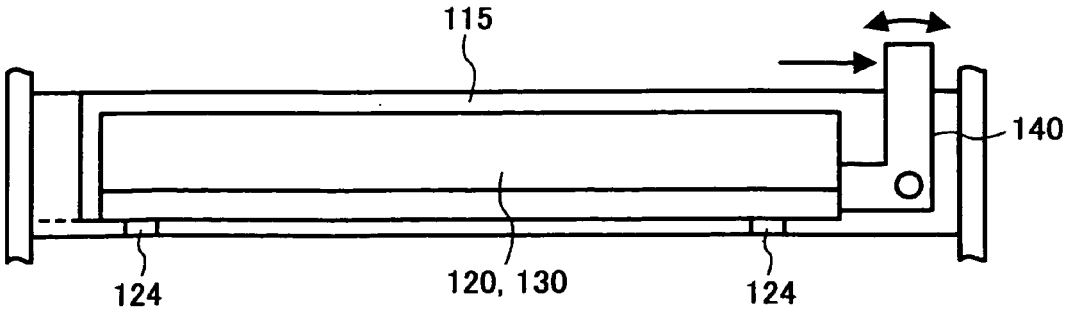
FIG. 23 is a cross sectional view of a lock mechanism for a shutter mechanism according to an embodiment of the present invention.

FIG. 23 is a cross sectional view of a lock mechanism for a shutter mechanism according to an embodiment of the present invention. During a period when the photoconductor unit 102 is removed from the image forming section 101 for evaluation, repair, or replacement, to prevent toner and powder dust from entering the slit opening 118, it is preferable that the slit opening 118 cannot be opened even if user performs erroneous operations. Therefore, the color printer of the present embodiment includes a lock mechanism 140 at the rear side of the image forming section 101. During a period when the photoconductor unit 102 is removed from the image forming section 101 for evaluation, repair, or replacement, the lock mechanism 140 is configured to lock the shutter member 120 or 130 so that the slit opening 118 is kept closed. When the photoconductor unit 102 is inserted into the image forming section 101, the shutter member 120 or 130 is unlocked so that the shutter member 120 or 130 can move and the slit opening 118 is opened. With the above-described lock mechanism 140, the slit opening 118 can be prevented from being inadvertently opened by a user. Accordingly, toner and powder dust can be prevented from entering the slit opening 118. The lock mechanism 140 can be used for all the shutter mechanisms of FIGS. 18A through 22.

According to the above-described embodiments, the shutter member 120 or 130 is configured to open and close the slit opening 118 by closing and opening the cover plate 150 by pressing and releasing the bias member with the protruding member 160. In place of the protruding member 160, an end portion of the shutter member 120 or 130 can extend toward the cover plate 150. In this configuration, the shutter member 120 or 130 can be configured to open and close the slit opening 118 by closing and opening the cover plate 150 by pressing and releasing the extended end portion of the shutter member 120 or 130. Alternatively, any other configuration of the drive device can be employed so long as the shutter member 120 or 130 can be moved backward and forward to open and close the slit opening 118.

Figure 24A:
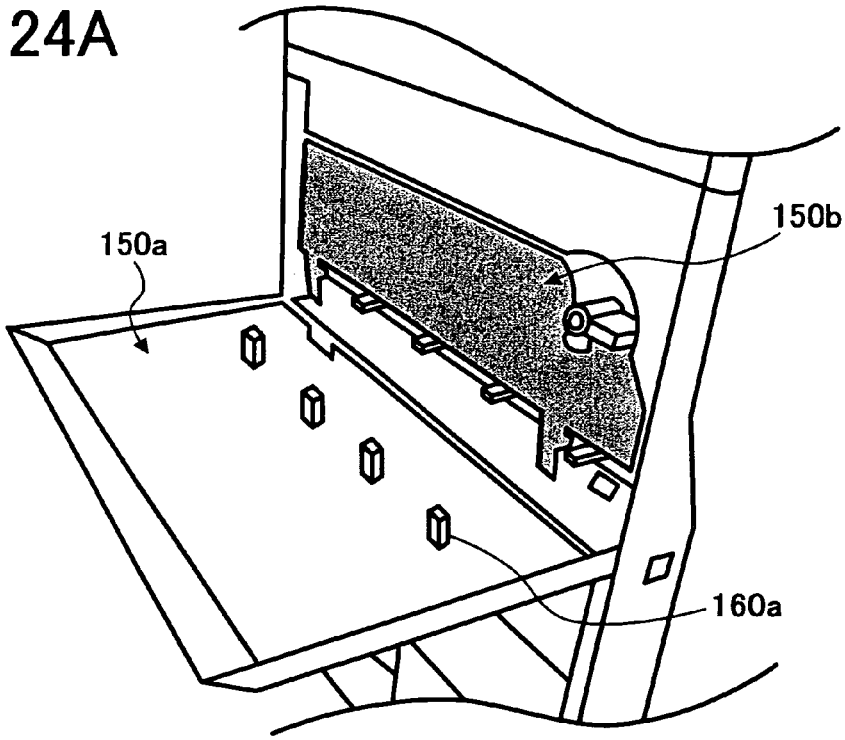
FIG. 24A is a perspective view of a portion of the color printer when an outer cover plate is opened and an inner cover plate is closed.
Figure 24B:
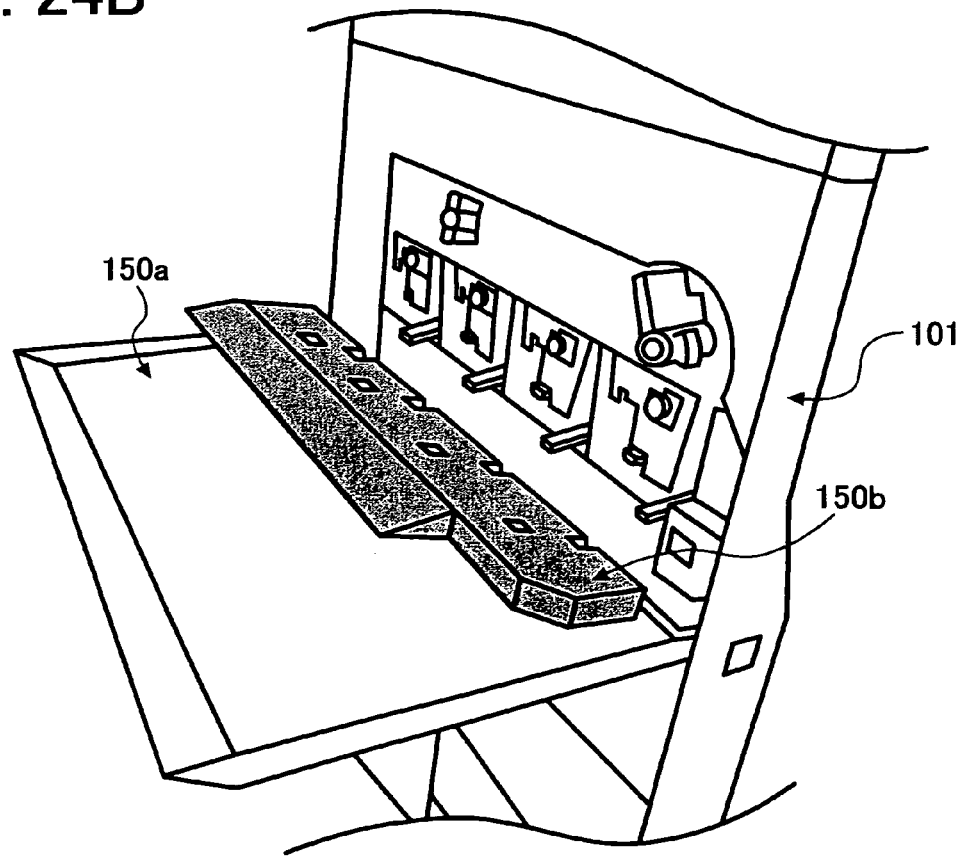
FIG. 24B is a perspective view of a portion of the color printer when the outer cover plate and the inner cover plate are opened.

As an alternative configuration, the color printer can include an outer cover plate 150*a* and an inner cover plate 150*b* as illustrated in FIGS. 24A and 24B. FIG. 24A is a perspective view of a portion of the color printer when the outer cover plate 150*a* is opened and the inner cover plate 150*b* is closed. FIG. 24B is a perspective view of a portion of the color printer when the outer cover plate 150*a* and the inner cover plate 150*b* are opened. The outer cover plate 150*a* is disposed over the front side of the color printer to cover the image forming section 101 including the photoconductor units 102, the transfer device 103, the optical writing device 104, the developing units 106, and the intermediate transfer belt 107. The inner cover plate 150*b* is also disposed over the front side of the color printer to cover a portion of the image forming section 101, such as the photoconductor units 102, the transfer device 103, the developing units 106, and the intermediate transfer belt 107. A plurality of protruding members 160*a*, such as ribs, is provided on the inner side of the outer cover plate 150*a* as illustrated in FIG. 24A. When the outer cover plate 150*a* is opened in a condition that the inner cover plate 150*b* is closed, the protruding members 160*a* move from the rear side to the front side in FIG. 24A, and thereby the shutter members 120 or 130 move forward in a direction approaching and contacting the slit openings 118. As a result, the slit openings 118 are closed with the shutter members 120 or 130. Subsequently, as illustrated in FIG. 24B, the inner cover plate 150*b* is opened for evaluation, repair, or replacement of the photoconductor units 102 and the developing units 106. When the outer cover plate 150*a* is closed after closing the inner cover plate 150*b*, the protruding members 160*a* contact and press the biasing members from the front side to the rear side in FIG. 24A, and thereby the shutter members 120 or 130 move backward in a direction away from the slit openings 118. As a result, the slit openings 118 open.

The protruding members 160*a* can be provided on the inner side of the inner cover plate 150*b* instead of the outer cover plate 150*a*. However, scattered toner and powder dust can be further prevented from entering the slit openings 118 by closing the slit openings 118 with the shutter members 120 or 130 immediately upon opening the outer cover plate 150*a* with the protruding members 160*a*.

Figure 25:
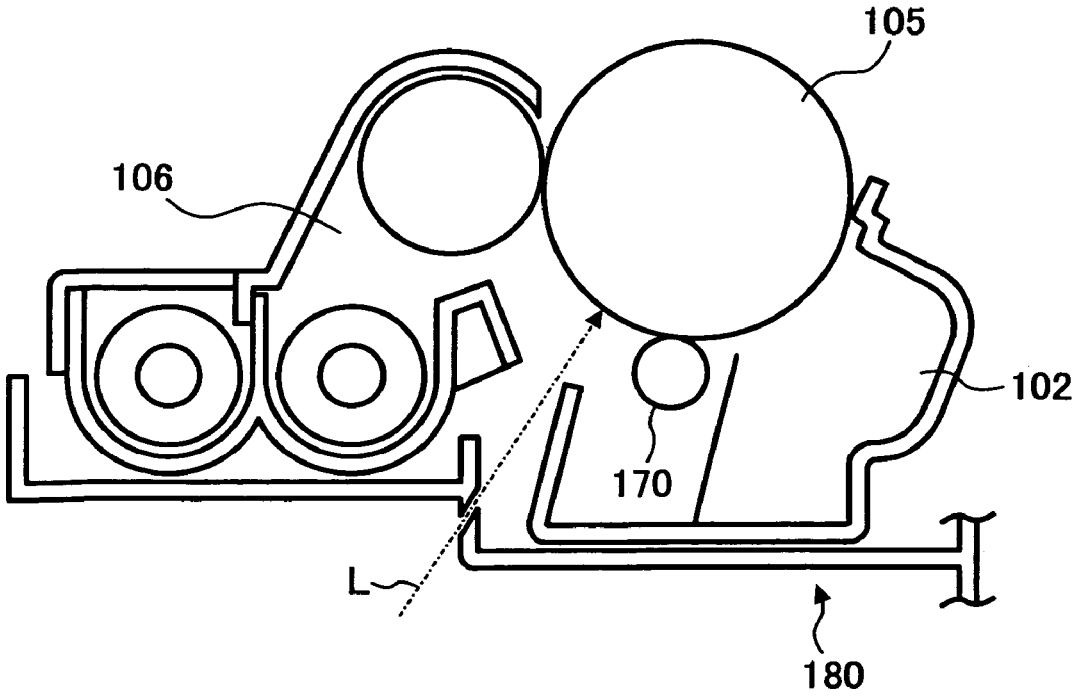
FIG. 25 is a schematic view of a process cartridge according to an embodiment of the present invention.

In the color printer of the present embodiment, the photoconductor unit 102 and the developing unit 106 are configured to be separately replaced due to difference in their useful lifetimes. However, the photoconductor unit 102 including a charging roller 170, etc. and the developing unit 106, can be integrally accommodated in a process cartridge 180 for easy maintenance and operability as illustrated in FIG. 25.

According to the embodiments of the present invention, scattered toner and powder dust are minimized or avoided from entering the optical writing device 104 through the slit openings 118. Therefore, an occurrence of a white streak image, which is caused by toner and powder dust interrupting the emission of laser light beams toward the photoreceptors 105, can be prevented.

The present invention has been described with respect to the exemplary embodiments illustrated in the figures. However, the present invention is not limited to these embodiments and can be practiced otherwise.

The present invention has been described with respect to a color printer as an example of an image forming apparatus. However, the present invention can be applied to other image forming apparatuses, such as a copying machine, a facsimile machine, etc. or a multi-functional image forming apparatus.

Further, in place of a tandem-type image forming apparatus including a plurality of photoreceptors, the present invention can be applied to an image forming apparatus including one photoreceptor on which toner images of different colors are sequentially formed.

Numerous additional modifications and variations of the present invention are possible in light of the above teachings. It is therefore understood that within the scope of the appended claims, the present invention can be practiced other than as specifically described herein.

What is claimed:

1. An optical writing device comprising:

an optical writing unit configured to emit a laser light beam toward at least one image carrier disposed above the optical writing unit so as to form an electrophotographic latent image on the at least one image carrier;

an outer case configured to accommodate the optical writing unit, the outer case including at least one first opening through which the laser light beam passes; and at least one air supplying device configured to supply air into the outer case, wherein the optical writing unit includes:

optical members configured to emit the laser light beam;

an inner case provided inside the outer case and configured to accommodate the optical members, the inner case including at least one second opening through which the laser light beam emitted from the optical members towards the at least one first opening passes; and a dust-proof glass configured to close the at least one second opening, the dust-proof glass allowing the laser light beam to transmit through the dust-proof glass, and the outer case includes:

at least one rise wall portion formed on a surface of the outer case that faces the at least one image carrier and extended toward the at least one image carrier, the at least one first opening being formed on the at least one rise wall portion, wherein the air supplied from the at least one air supplying device flows along the dust-proof glass provided to the at least one second opening and through an open space formed between a surface of the inner case and a surface of the outer case that face with each other and blows out of the outer case through the at least one first opening through which the laser light beam passes.

2. The optical writing device according to claim 1, wherein the optical writing unit is detachably attached in the outer case.

3. The optical writing device according to claim 1, wherein the at least one first opening comprises a plurality of first openings, and wherein the optical writing device further comprises first guide ribs disposed at an outer peripheral portion of the inner case and configured to direct the air supplied into the outer case to the plurality of first openings such that the air is blown out from the plurality of first openings substantially equally.

4. The optical writing device according to claim 1, wherein the at least one first opening is configured to be disposed in an upper portion of the outer case in a vertical direction when the optical writing device is attached to an image forming apparatus.

5. The optical writing device according to claim 1, further comprising:

at least one air-intake path having one end connected to the outer case and another end configured to communicate with the outside of the image forming apparatus to which the optical writing device is attached, the at least one air-intake path configured to receive the air supplied from the outside by the at least one air supplying device before the air reaches the outer case; and a filter disposed in the air-intake path.

6. The optical writing device according to claim 5, wherein the filter is configured to be detachably attached to the air-intake path.

7. The optical writing device according to claim 1, wherein the at least one air supplying device comprises a fan.

8. The optical writing device according to claim 1, wherein the at least one rise wall portion includes side walls extending substantially perpendicular to a top surface of the upper case, and wherein the at least one first opening is provided in a side wall.

9. The optical writing device according to claim 8, wherein the opening provided in the side wall is a slit opening such that a projected portion of the slit opening does not project beyond a plane formed by the side wall.

10. The optical writing device according to claim 8, wherein each of the at least one image carriers is disposed above respective rise wall portions towards the side wall of the rise wall portion having the first opening.

11. An image forming apparatus comprising:

an image forming device comprising at least one image carrier, the image forming device configured to form a toner image on the at least one image carrier by an electrophotography process; and an optical writing device configured to form an electrophotographic latent image on the at least one image carrier, the optical writing device comprising:

an optical writing unit configured to emit a laser light beam toward the at least one image carrier disposed above the optical writing unit so as to form the electrophotographic latent image on the at least one image carrier;

an outer case configured to accommodate the optical writing unit, the outer case including at least one first opening through which the laser light beam passes; and at least one air supplying device configured to supply air into the outer case, wherein the optical writing unit includes:

optical members configured to emit the laser light beam;

an inner case provided inside the outer case and configured to accommodate the optical members, the inner case including at least one second opening through which the laser light beam emitted from the optical members towards the at least one first opening passes; and a dust-proof glass configured to close the at least one second opening, the dust-proof glass allowing the laser light beam to transmit through the dust-proof glass, and the outer case includes:

at least one rise wall portion formed on a surface of the outer case that faces the at least one image carrier and extended toward the at least one image carrier, the at least one first opening being formed on the at least one rise wall portion, wherein the air supplied from the at least one air supplying device flows along the dust-proof glass provided to the at least one second opening and through an open space formed between a surface of the inner case and a surface of the outer case that face with each other and blows out of the outer case through the at least one first opening through which the laser light beam passes.

12. The image forming apparatus according to claim 11, wherein the optical writing unit is configured to be detachably attached in the outer case.

13. The image forming apparatus according to claim 11, wherein the at least one first opening comprises a plurality of first openings, and wherein the optical writing device further comprises first guide ribs disposed at an outer peripheral portion of the inner case and configured to direct the air supplied into the outer case to the plurality of first openings such that the air is blown out from the plurality of first openings substantially equally.

14. The image forming apparatus according to claim 11, wherein the at least one first opening is configured to be disposed in an upper portion of the outer case in a vertical direction when the optical writing device is attached into the image forming apparatus.

15. The image forming apparatus according to claim 11, wherein the at least one rise wall portion includes side walls extending substantially perpendicular to a top surface of the upper case, and wherein the at least one first opening is provided in a side wall.

16. The image forming apparatus according to claim 15, wherein the opening provided in the side wall is a slit opening such that a projected portion of the slit opening does not project beyond a plane formed by the side wall.

17. The image forming apparatus according to claim 15, wherein each of the at least one image carriers is disposed above respective rise wall portions towards the side wall of the rise wall portion having the first opening.

* * * * *